US011555411B2

(12) United States Patent
Brandl et al.

(10) Patent No.: US 11,555,411 B2
(45) Date of Patent: Jan. 17, 2023

(54) TECHNIQUE FOR COOLING SQUEALER TIP OF A GAS TURBINE BLADE

(71) Applicant: DOOSAN ENERBILITY CO., LTD, Changwon-si (KR)

(72) Inventors: Herbert Brandl, Baden (CH); Joerg Krueckels, Baden (CH); Ulrich Rathmann, Baden (CH); Willy Heinz Hofmann, Baden (CH)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/398,187

(22) Filed: Aug. 10, 2021

(65) Prior Publication Data

US 2022/0090511 A1 Mar. 24, 2022

(30) Foreign Application Priority Data

Sep. 24, 2020 (EP) ..... 20198003

(51) Int. Cl.
*F01D 11/18* (2006.01)
*F01D 5/18* (2006.01)

(52) U.S. Cl.
CPC ..... *F01D 11/18* (2013.01); *F01D 5/186* (2013.01); *F05D 2220/32* (2013.01); *F05D 2240/307* (2013.01); *F05D 2240/55* (2013.01); *F05D 2260/202* (2013.01)

(58) Field of Classification Search
CPC . F01D 11/18; F01D 5/186; F01D 5/20; F01D 5/187; F05D 2220/32; F05D 2240/307; F05D 2240/55; F05D 2260/202
See application file for complete search history.

(56) References Cited

U.S. PATENT DOCUMENTS 7,494,319 B1 * 2/2009 Liang ..... F01D 11/10 416/97 R
2002/0197160 A1 12/2002 Liang
2010/0135822 A1 * 6/2010 Marini ..... F01D 5/20 416/97 R
2012/0282108 A1 11/2012 Lee
2017/0159451 A1 * 6/2017 Buhler ..... F01D 5/186
2018/0328191 A1 * 11/2018 Subramaniyan ..... F01D 5/20
(Continued)

FOREIGN PATENT DOCUMENTS

KR 20190108552 A 9/2019
WO 2019188588 A1 10/2019

OTHER PUBLICATIONS

European Patent Office Search Report dated Feb. 19, 2021.

*Primary Examiner* — Courtney D Heinle
*Assistant Examiner* — Andrew Thanh Bui
(74) *Attorney, Agent, or Firm* — Harvest IP Law LLP

(57) ABSTRACT

The present technique presents a blade 1 for a gas turbine 10. The blade 1 includes an airfoil 100 having an airfoil tip part 100*a* and a pressure side 102 and a suction side 104 meeting at a leading edge 106 and a trailing edge 108 and defining an internal space 100*s* of the airfoil 100. A squealer tip 80, 90 is arranged at the airfoil tip part 100*a*. The squealer tip 80, 90 comprises a suction side rail 90. The suction side rail 90 comprises a chamfer part 90*x* and at least one squealer tip cooling hole 99. The chamfer part 90*x* comprises a chamfer surface 9. An outlet 99*a* of the at least one squealer tip cooling hole 99 is disposed at the chamfer surface 9.

20 Claims, 16 Drawing Sheets

(56) References Cited

U.S. PATENT DOCUMENTS

| | | | | |
|---|---|---|---|---|
| 2019/0017389 | A1* | 1/2019 | Rathay | F01D 5/186 |
| 2019/0249553 | A1 | 8/2019 | Lee | |
| 2021/0071535 | A1* | 3/2021 | Miyahisa | F01D 5/187 |

* cited by examiner

TECHNIQUE FOR COOLING SQUEALER TIP OF A GAS TURBINE BLADE

CROSS REFERENCE TO RELATED APPLICATION

The present application claims priority to European Patent Application No. 20198003.4, filed on Sep. 24, 2020, the entire contents of which are incorporated herein for all purposes by this reference.

FIELD OF THE INVENTION

The present invention relates to gas turbines, and more particularly to techniques for cooling squealer tip of a gas turbine blade.

BACKGROUND OF THE INVENTION

Gas turbine blades include an airfoil extending radially outwards, with respect to a rotation axis of the gas turbine, from a blade platform. The airfoil has pressure and suction sides extending between the leading and trailing edges of the airfoil. The airfoil also includes a tip part that is disposed at a radially outward end of the airfoil. The tip part, also referred to as the tip of the airfoil, faces a surface of the stator disposed further radially outwards of the airfoil and which generally defines an outer surface of the hot gases or combustion gases path through the gas turbine. The surface of the stator that the tip part of the airfoil faces may be an inner surface of the casing or an inner surface of a turbine shroud, and so on and so forth.

The tip of the airfoil is placed spaced apart, i.e. in a non-contact manner, from the facing stator surface. In other words, a radial clearance or gap is included between the tip of the airfoil and the facing stator surface to avoid chances of collision or rubbing between the tip of the airfoil and the facing stator surface when the gas turbine is operated. However, parts of the hot gases, i.e. the combustion products, flowing through the hot gas path leak through the radial clearance, instead of flowing over the turbine blade airfoil, and thus cause a decrease in efficiency.

Therefore, the radial clearance between the tip of the airfoil and the facing stator surface is desired to be kept as small as possible to minimize the leakage of the hot gases.

To keep the radial clearance small, and to safeguard the airfoil body from structural damage in an event of accidental contact between the tip of the airfoil and the facing stator surface during operation of the gas turbine, it is well known in the art of gas turbines to employ a squealer tip structure disposed at the tip of the airfoil and extending radially outwards towards the facing stator surface.

The squealer tip generally is shaped as a rail positioned at and extending along a periphery of the airfoil tip part, for example the squealer tip may have a suction side rail positioned at and extending along a periphery of the suction side at the airfoil tip part, and a pressure side rail positioned at and extending along a periphery of the pressure side at the airfoil tip part.

Since, the squealer tip is bathed in hot combustion products, i.e. the hot gases, a cooling of the squealer tip is desired, particularly at the suction side rail. However, since the squealer tip is disposed very close to the facing stator surface, an undesired event of accidental contact between the squealer tip and the facing stator surface may occur during operation of the gas turbine—known as a rub event.

Thus, any cooling holes that may be disposed at the squealer tip may get damaged or blocked.

Therefore, it is an object of the present invention to provide a mechanism or technique for effectively cooling the squealer tip. Preferably, the technique for cooling the squealer tip is desired to at least partially obviate the damage to cooling of the squealer tip in case of an occurrence of a rub event.

SUMMARY OF THE INVENTION

One or more of the above objects are achieved by a blade for a gas turbine, a blade assembly for a gas turbine and a gas turbine according to independent claim(s) appended to the present disclosure. Advantageous embodiments of the present technique are provided in dependent claims. Features of independent claim may be combined with features of claims dependent on the independent claim, and features of dependent claims can be combined with each other.

In a first aspect of the present technique, a blade for a gas turbine is presented, particularly for a turbine section of the gas turbine. The blade, hereinafter also referred to as the turbine blade, includes an airfoil. The airfoil has an airfoil tip part. The airfoil also includes a pressure side and a suction side that meeting at a leading edge and a trailing edge and defining an internal space, also referred to as airfoil cavity.

The blade may also include a platform having a first and a second surface. From the first surface of the platform the airfoil may emanate towards a radially outward direction of the blade and from the second surface of the platform a root of the blade may emanate towards an opposite direction, i.e. towards a radially inward direction of the blade. The airfoil tip part may be formed as a wall extending between the pressure side and the suction side of the airfoil and defining a radially outward boundary of the airfoil cavity. The airfoil cavity may be present between the airfoil tip part or wall and the platform.

The blade also includes a squealer tip. The squealer tip is arranged at the airfoil tip part. The squealer tip comprises a suction side rail. The suction side rail comprises a chamfer part and at least one squealer tip cooling hole. The chamfer part comprises at least one chamfer surface. An outlet of the at least one squealer tip cooling hole is disposed at the chamfer surface.

The at least one squealer tip cooling hole may be in fluid communication with the airfoil cavity. Cooling air may flow from the airfoil cavity into the at least one squealer tip cooling hole, and out of the outlet of the at least one squealer tip cooling hole disposed at the chamfer surface. An inlet of the at least one squealer tip cooling hole may be in fluid communication with the at least one squealer tip cooling hole, for example an inlet of the at least one squealer tip cooling hole may be positioned at the airfoil cavity.

In the present disclosure, all references to the chamfer surface means the chamfer surface at which or on which the outlets of the squealer tip cooling hole are disposed, unless otherwise stated.

In the present disclosure, all references to the chamfer part means chamfer part comprising chamfer surface at which or on which the outlets of the squealer tip cooling hole are disposed, unless otherwise stated.

The suction side rail may comprise an inner peripheral surface, an outer peripheral surface and an upper surface.

The inner peripheral surface may be adjacent to or contiguous with a squealer tip pocket defined by the suction side rail at the outer surface of the airfoil tip part, i.e. over or above the airfoil tip part. The outer peripheral surface may be adjacent to the suction side of the airfoil. The outer peripheral surface and the inner peripheral surface may be opposite to each other. The upper surface may connect the outer and the inner peripheral surfaces. The upper surface may be the radially outermost surface of the suction side rail and/or the blade.

The chamfer surface may extend between the upper surface and the inner peripheral surface. In other words, in the chamfer part, an inner peripheral portion of the suction side rail may be formed as the chamfer surface or may include the chamfer surface. To explain further, the chamfer surface may be formed at a surface of the suction side rail that is contiguous with a squealer tip pocket defined by the squealer tip at an upper surface or outer surface of the airfoil tip part or wall.

The chamfer surface may be a beveled edge i.e. the chamfer surface may extend from an outer surface of the airfoil tip part upto an upper surface, i.e. an uppermost surface, of the suction side rail. When formed as a beveled edge, the chamfer surface provides more surface area and thus can accommodate more squealer tip cooling holes outlets, i.e. outlets of more squealer tip cooling holes may be positioned in the chamfer surface.

The chamfer surface may extend between the upper surface and the outer peripheral surface. In other words, in the chamfer part, an outer peripheral portion of the suction side rail may be formed as the chamfer surface or may include the chamfer surface. To explain further, the chamfer surface may be formed at a surface of the suction side rail that is contiguous with the suction side, particularly an outer surface of the suction side. Thus, during an occurrence of a rub event, the cooling air exiting the squealer tip cooling holes is discharged outwardly of the airfoil i.e. not towards or into a blocked surface of the squealer tip which may be blocked by the surface of the stator facing the squealer tip—and thus cooling air flow through the squealer tip cooling holes is continuously and efficiently maintained.

The chamfer surface may be a beveled edge i.e. the chamfer surface may extend from an outer surface of the suction side of the airfoil upto an upper surface, i.e. an uppermost surface, of the suction side rail. When formed as a beveled edge, the chamfer surface provides more surface area and thus can accommodate more squealer tip cooling holes outlets, i.e. outlets of more squealer tip cooling holes may be positioned in the chamfer surface.

The suction side rail may include two chamfer surfaces, for example a first chamfer surface including at least one outlet of a squealer tip cooling hole and extending between the upper surface and the inner peripheral surface, and a second chamfer surface including at least one outlet of a squealer tip cooling hole and extending between the upper surface and the outer peripheral surface. The squealer tip cooling hole of the first and the second chamfer surface may have the same inlet, or may have separate inlets.

The chamfer surface may comprise a thermal barrier coating. The thermal barrier coating makes the suction side rail, which is cooled as a consequence of cooling air flow through the squealer tip cooling hole, further heat resistant, thus increasing the overall performance of the gas turbine.

The chamfer surface may have an upper peripheral edge and a lower peripheral edge. The upper peripheral edge is radially outwards, i.e. with outward respect to a longitudinal axis of the blade extending from the platform of the blade towards the blade tip, of the lower peripheral edge. In other words, the chamfer surface may be defined or limited by the upper and the lower peripheral edges. The lower peripheral edge may be disposed between the upper peripheral edge or the chamfer surface and the airfoil e.g. the suction side of the airfoil or an outer surface of the suction side of the airfoil.

The outlet of the squealer tip cooling hole may be centrally located between the upper peripheral edge and the lower peripheral edge. Thus, providing an even cooling of the chamfer surface and of the chamfer part of the suction side rail.

Alternatively, the outlet of the squealer tip cooling hole may be located closer to the lower peripheral edge than the upper peripheral edge. Due to such location, the outlets of the squealer tip cooling hole are further away from the surface of the stator facing the squealer tip that the suction side rail may come into contact with during occurrence of a rub event, and hence chance of blocking of the outlets of the squealer tip cooling hole is further obviated.

Alternatively, the outlet of the squealer tip cooling hole may be located closer to the upper peripheral edge than the lower peripheral edge.

The chamfer surface may be flat. In other words, in a cross-section of the chamfer part, the chamfer surface may be defined by a straight line. Such flat surfaces are easy to manufacture in the suction side rail. In other words, a cross-section, e.g. a vertical section, of the chamfer part may have polygonal shape, such as triangular, conical, quadrangular, pentagonal, and so on and so forth, and the chamfer surface in the cross-section may be a straight line.

The chamfer surface may be curved surface. In other words, in a cross-section of the chamfer part, the chamfer surface may be defined by a curved line. Such curved surfaces provide more surface area for placing outlets of more squealer tip cooling holes, as compared to a flat surface.

The squealer tip cooling hole may be a cylindrical hole. Such holes may be easily manufactured for example simply by drilling.

The squealer tip cooling hole may be a fan-shaped hole or funnel-shaped hole or a countersunk hole. Such fan shaped or funnel shaped holes have increased cross-sectional area or greatest cross-sectional area at the outlet of the hole. Such shape reduces cooling air velocity or exit velocity of the cooling air i.e. blowing ratio. With reduced velocity the cooling air snuggles better to the surface and stays longer attached to the surface. In consequence, heat input from hot gas is reduced because the cooling air works as a buffer layer i.e. film cooling. Furthermore, due to increased cooling effect due to increased area of contact between the cooling air flowing in the hole and the region or internal surface of the suction side rail defining the hole, at the outlet of the hole which is at the curved surface of the suction side rail and thus at elevated temperatures as compared to inner parts of the suction side rail. In short, the fan shaped, or funnel shaped, or countersunk holes provide increased cooling of the chamfer surface, and consequently of the suction side rail.

The squealer tip cooling hole may be a counterbore hole. The counterbore hole also provides increased cooling of the chamfer surface, and consequently of the suction side rail, for same reasons as explained hereinabove for the countersunk hole.

The squealer tip cooling hole may be a branched hole. In other words, one squealer tip cooling hole may have one inlet but two or more outlets.

The chamfer part or the chamfer surface may extend along an outer surface of the suction side i.e. parallel to an upper edge of the outer surface of the suction side.

The chamfer part or the chamfer surface may extend along a suction side of the airfoil i.e. in other words parallel to the upper edge, i.e. radially outward edge, of the outer surface of the suction side.

The chamfer part or the chamfer surface may be positioned at the upper edge, radially outward edge, of the outer surface of the suction side.

A shape of chamfer part or the chamfer surface in a direction between the leading and the trailing edges may correspond to a shape the outer surface of the suction side in the direction between the leading and the trailing edges.

The chamfer part or the chamfer surface may extend continuously or intermittently between the leading edge and the trailing edge.

The chamfer part or the chamfer surface may have same length as that of the upper edge, radially outward edge, of the outer surface of the suction side.

The chamfer part or the chamfer surface may have a smaller length as that of the upper edge, radially outward edge, of the outer surface of the suction side.

The chamfer part may extend from a first position to a second position along the suction side rail. The first position may be at a first distance from the leading edge, i.e. from a position of the leading edge. The second position may be at a second distance from the trailing edge i.e. from a position of the trailing edge.

The first distance may be less than the second distance. In other words, the chamfer part may be closer to the leading edge than to the trailing edge, when measured along the upper edge, i.e. radially outward edge, of the suction side. Since the region around the leading edge is subject to higher temperatures due to hot gas flow, such arrangement of the chamfer part and thus of the outlets of the squealer tip cooling holes provides efficient cooling of the blade.

The first distance may be greater than the second distance. In other words, the chamfer part may be closer to the trailing edge than to the leading edge, when measured along the upper edge, i.e. radially outward edge, of the suction side.

The first distance may be between 10 percent and 80 percent of a length of the suction side. Preferably, the first distance may be between 10 percent and 40 percent of the length of the suction side. More preferably, the first distance may be 20 percent of the length of the suction side. The length may be measured along upper edge, i.e. radially outward edge of the outer surface of the suction side i.e. measured along the tip part of the airfoil.

The second distance may be between 10 percent and 80 percent of a length of the suction side. Preferably, the second distance may be between 20 percent and 60 percent of the length of the suction side. More preferably, the second distance may be 40 percent of the length of the suction side. The length may be measured along upper edge, i.e. radially outward edge of the outer surface of the suction side i.e. measured along the tip part of the airfoil.

The position of the leading edge may be understood as a point or position or location at which the leading edge has a maximum curvature or in other words has minimum radius.

The position of the trailing edge may be understood as a point or position or location at which the trailing edge has a maximum curvature or in other words has minimum radius.

The suction side rail may comprise at least one non-chamfer part adjacent to the chamfer part.

The non-chamfer part, e.g. a first non-chamfer part, may extend between the chamfer part and the leading edge. For example, the first non-chamfer part, may extend between the first position of the chamfer part and the leading edge.

The non-chamfer part, e.g. a second non-chamfer part, may extend between the chamfer part and the trailing edge. For example, the second non-chamfer part, may extend between the second position of the chamfer part and the trailing edge.

By having the non-chamfer parts adjoining or adjacent to the chamfer part, the chamfer part of the suction side rail is supported or reinforced, making the chamfer part sturdy, and thereby increasing the overall strength of the suction side rail. Thus, the structural integrity of the suction side rail is maintained during operation of the gas turbine.

A height of the chamfer surface along a radial direction of the blade, i.e. measured in a direction vertical to the blade platform or the airfoil tip part or in a radial direction, may be between 1 mm and 15 mm, and particularly between 2 mm and 3 mm.

An angle between the chamfer surface and the suction side may be between 5 degree and 75 degree, and particularly between 30 degree and 60 degree.

The chamfer part may be formed continuously i.e. as an integral structure. In other words, the suction side rail may comprise only one chamfer part.

Alternatively, the chamfer part may be formed intermittently. In other words, the chamfer part may comprise a plurality of chamfer sub-parts. The chamfer sub-parts may be spaced apart from each other by a gap part. The gap part may be an unchamfered part of the suction side rail.

Each chamfer sub-part may comprise the chamfer surface, i.e. part of the chamfer surface, and at least one squealer tip cooling hole. An outlet of the at least one squealer tip cooling hole of chamfer sub-part may be disposed at the chamfer surface of the chamfer sub-part.

By having the gap part physically connecting or joining adjacent sub-chamfer parts, the sub-chamfer parts are supported or reinforced, making the entire chamfer part sturdy, and thereby increasing the overall strength of the suction side rail. Thus, the structural integrity of the suction side rail is maintained during operation of the gas turbine.

Furthermore, due to the provision of the sub-chamfer parts, the advantage of unblocked cooling air flow through and out of the squealer tip cooling hole is spread over a greater area around the suction side, and can be implemented by chamfering relatively smaller area of the suction side rail.

The blade may further include at least one airfoil tip wall cooling hole. An outlet of the airfoil tip wall cooling hole may be positioned at an upper surface of the airfoil tip part. Thus, cooling the airfoil tip part in addition to the suction side rail is achieved.

Optionally, the outlet of the airfoil tip wall cooling hole may be directed towards or facing or oriented towards the suction side rail and consequently may direct cooling air exiting therefrom towards the suction side rail.

The airfoil tip wall cooling hole may be understood as a cooling air flow channel or through-hole at least partially, and preferably completely embedded within the airfoil tip wall. Only the outlet of the airfoil tip wall cooling hole may be positioned at an outer surface of the airfoil tip wall. The inlet of the airfoil tip wall cooling hole may be in fluid communication with the airfoil cavity i.e. may be positioned at the airfoil cavity.

The suction side rail of the blade may further include at least one auxiliary squealer tip cooling hole. An outlet of the auxiliary squealer tip cooling hole may be positioned at or disposed at a surface of the suction side rail outside the chamfer surface, for example at the inner peripheral surface and/or the outer peripheral surface and/or the upper surface of the suction side rail.

Optionally, the outlet of the auxiliary squealer tip cooling hole may be positioned in the chamfer part.

Optionally, the outlet of the auxiliary squealer tip cooling hole may be positioned in the non-chamfer part.

A second aspect of the present technique presents a turbine blade assembly. The turbine blade assembly includes at least one blade and a rotor disk. The at least one blade is coupled to the rotor disk. The at least one blade is according to the first aspect of the present technique.

A third aspect of the present technique presents a gas turbine including at least one blade. The at least one blade is according to the first aspect of the present technique.

BRIEF DESCRIPTION OF THE DRAWINGS

The above mentioned attributes and other features and advantages of the present technique and the manner of attaining them will become more apparent and the present technique itself will be better understood by reference to the following description of embodiments of the present technique taken in conjunction with the accompanying drawings, wherein.

Figure 1:
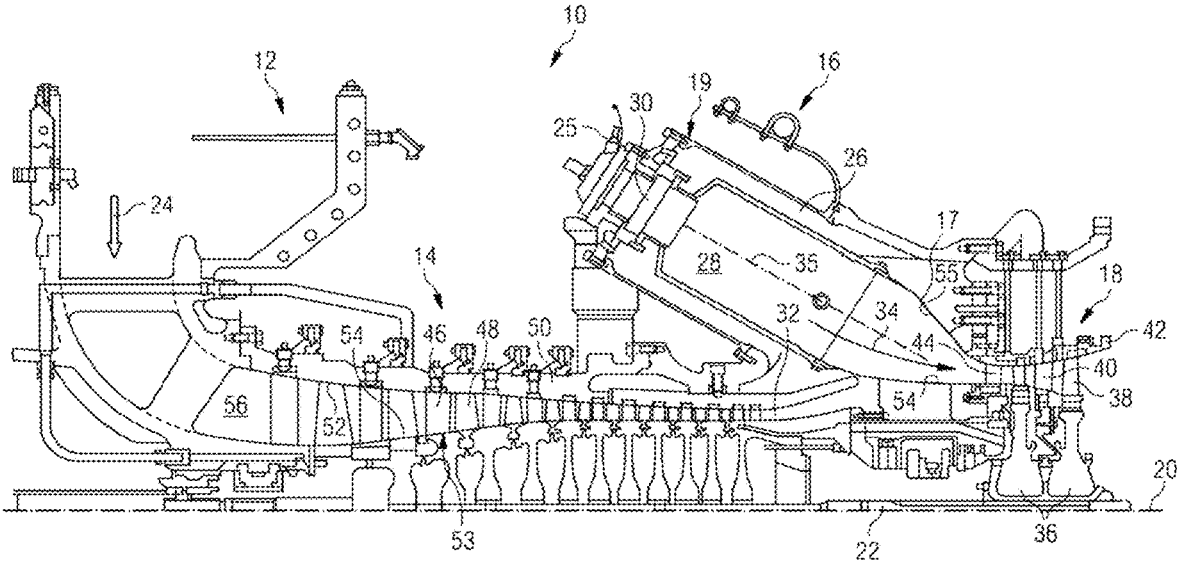
FIG. 1 shows a sectional view of a part of an exemplary embodiment of a gas turbine in which an exemplary embodiment of a turbine blade of the present technique may be incorporated.

Hereinafter, above-mentioned and other features of the present technique are described in detail. Various embodiments are described with reference to the drawing, wherein like reference numerals are used to refer to like elements throughout. In the following description, for purpose of explanation, numerous specific details are set forth in order to provide a thorough understanding of one or more embodiments. It may be noted that the illustrated embodiments are intended to explain, and not to limit the invention. It may be evident that such embodiments may be practiced without these specific details.

FIG. 1 shows an example of a gas turbine or gas turbine engine 10 in a sectional view. The gas turbine engine 10 may comprises, in flow series, an inlet 12, a compressor or compressor section 14, a combustor section 16 and a turbine section 18 which are generally arranged in flow series and generally about and in the direction of a longitudinal or rotational axis 20. The gas turbine engine 10 may further comprises a shaft 22 which is rotatable about the rotational axis 20 and which extends longitudinally through the gas turbine engine 10. The shaft 22 may drivingly connect the turbine section 18 to the compressor section 14.

In operation of the gas turbine engine 10, air 24, which is taken in through the air inlet 12 is compressed by the compressor section 14 and delivered to the combustion section or burner section 16. The burner section 16 may comprise a burner plenum 26, one or more combustion chambers 28 and at least one burner 30 fixed to each combustion chamber 28. The combustion chambers 28 and the burners 30 may be located inside the burner plenum 26. The compressed air passing through the compressor 14 may enter a diffuser 32 and may be discharged from the diffuser 32 into the burner plenum 26 from where a portion of the air may enter the burner 30 and is mixed with a gaseous or liquid fuel. The air/fuel mixture is then burned and the combustion gas 34 or working gas from the combustion is channeled through the combustion chamber 28 to the turbine section 18 via a transition duct 17.

This exemplary gas turbine engine 10 may have a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets may form an annulus for channeling the combustion gases to the turbine 18.

The turbine section 18 may comprise a number of blade carrying discs 36 attached to the shaft 22. In the present example, two discs 36 each carry an annular array of turbine blades 38 are depicted. However, the number of blade carrying discs could be different, i.e. only one disc or more than two discs. In addition, guiding vanes 40, which are fixed to a stator 42 of the gas turbine engine 10, may be disposed between the stages of annular arrays of turbine blades 38. Between the exit of the combustion chamber 28 and the leading turbine blades 38 inlet guiding vanes 44 may be provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimize the angle of the combustion or working gas on the turbine blades 38.

The turbine section 18 drives the compressor section 14. The compressor section 14 may comprise an axial series of vane stages 46 and rotor blade stages 48. The rotor blade stages 48 may comprise a rotor disc supporting an annular array of blades. The compressor section 14 may also comprise a casing 50 that surrounds the rotor stages and supports the vane stages 48. The guide vane stages may include an annular array of radially extending vanes that are mounted to the casing 50. The vanes are provided to present gas flow at an optimal angle for the blades at a given engine operational point. Some of the guide vane stages may have variable vanes, where the angle of the vanes, about their own longitudinal axis, can be adjusted for angle according to air flow characteristics that can occur at different engine operations conditions. The casing 50 may define a radially outer surface 52 of the passage 56 of the compressor 14. A radially inner surface 54 of the passage 56 may be at least partly defined by a rotor drum 53 of the rotor which may be partly defined by the annular array of blades 48.

The present technique is described with reference to the above exemplary gas turbine having a single shaft or spool connecting a single, multi-stage compressor and a single, one or more stage turbine. However, it should be appreciated that the present technique is equally applicable to two or three shaft engines and which can be used for industrial, aero or marine applications.

The terms upstream and downstream refer to the flow direction of the airflow and/or working gas flow through the engine unless otherwise stated. The terms forward and rearward refer to the general flow of hot gas through the engine. The terms axial, radial and circumferential are made with reference to the rotational axis 20 of the engine.

In the present technique, a turbine blade 1 including an airfoil 100 is presented—as shown for example in FIGS. 5A-16. The turbine blade 1 of the present technique may be the blade 38 of the gas turbine 10, described hereinabove.

Figure 2:
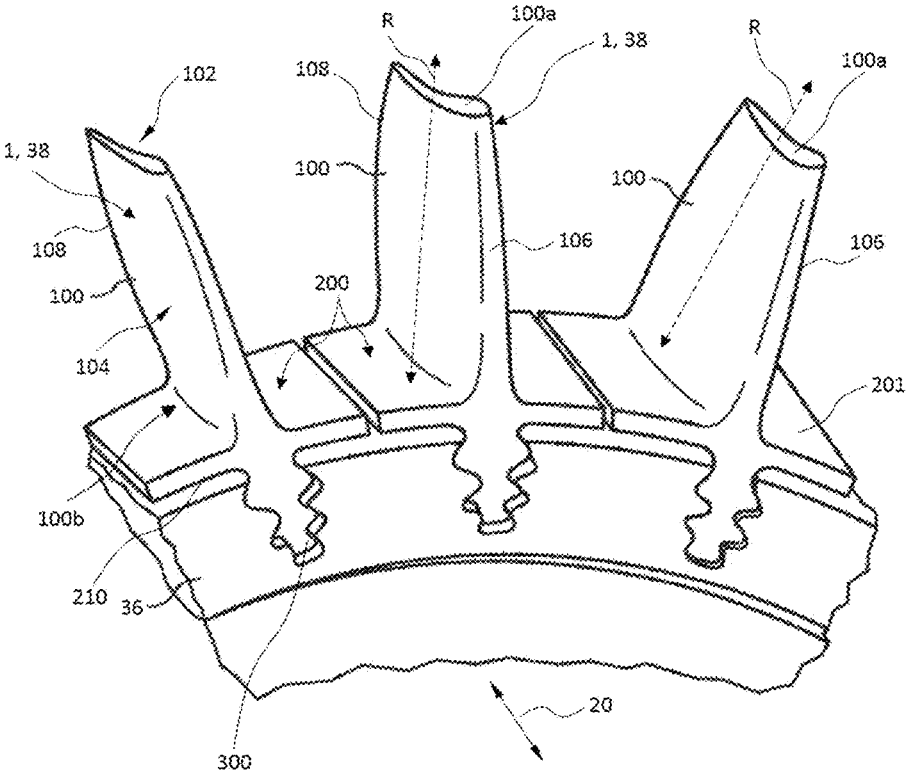
FIG. 2 schematically illustrates an exemplary embodiment of a turbomachine assembly in which an exemplary embodiment of the turbine blade of the present technique may be incorporated.
Figure 3:
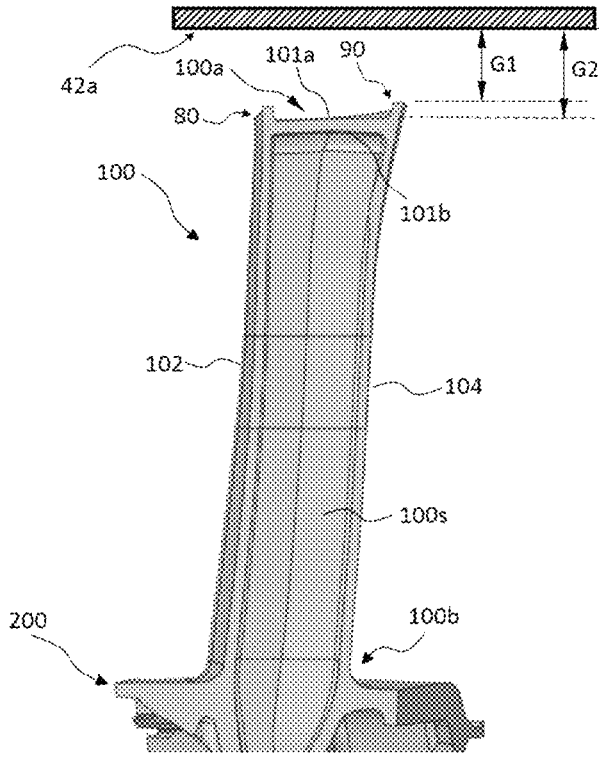
FIG. 3 is a vertical cross-sectional view illustrating an exemplary embodiment of the turbine blade.

FIG. 2 schematically depicts an example of a turbomachine assembly. The assembly may include the turbine blades 38, also referred to as the blade 1 of the present technique, arranged on and coupled to the rotor disk 36. As also shown in FIG. 3, the turbine blade 1 may include a platform 200, an airfoil 100 and optionally a root 300. The blade 1 may be fixed to or mounted onto the disk 36 via the root 300.

As shown in FIGS. 2 and 3, the turbine blade 1 may include a platform 200 and an airfoil 100 extending from the platform 200. The platform 200 may include an upper surface 201 and a lower surface 210. The airfoil 100 may extend from the upper surface 201 of the platform 200. The upper surface 201 may extend circumferentially. Similarly, the lower surface 210 may extend circumferentially. The airfoil 100 extends radially outwards from the upper surface 201 of the platform 200.

The airfoil 100 includes a pressure side 102 (also referred to as pressure surface or concave surface/side) and a suction side 104 (also referred to as suction side or convex surface/side). The pressure side 102 and the suction side 104 meet each other at a leading edge 106 and a trailing edge 108 of the airfoil 100.

The airfoil 100 may have a base part 100*b* adjoining the platform 200 and a tip part 100*a*, also referred to as the airfoil tip part or as simply the airfoil tip, spaced apart from the base part 100*b* along a longitudinal direction R of the airfoil 100.

The pressure side 102, the suction side 104, the leading edge 106 and the trailing edge 108 define an internal space 100*s* of the airfoil 100. The internal space 100*s* of the airfoil 100 may be limited by the tip part 100*a* i.e. by a wall of the tip part 100*a* disposed at the radially outermost end of the airfoil 100.

The airfoil tip part 100*a* may be formed as a wall having an outer surface or radially upper surface 101*a* and an inner surface or radially inner surface 101*b*.

The blade 1 includes a squealer tip 80, 90. The squealer tip 80, 90 may be disposed on the outer surface 101*a* of the airfoil tip part 100*a*.

Figure 4A:
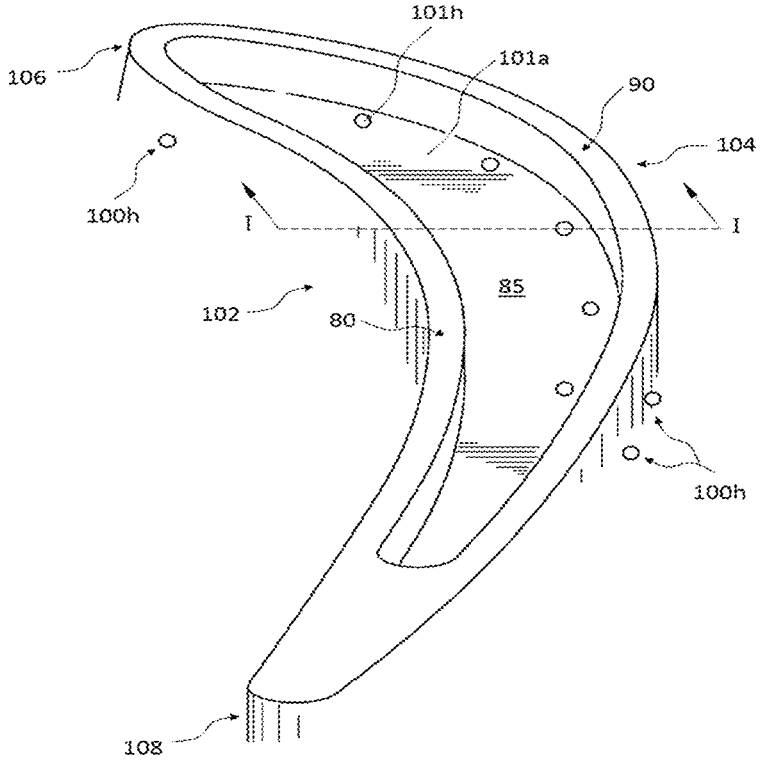
FIG. 4A (PRIOR ART)
FIG. 4A schematically depicts a perspective view a part of a conventional airfoil with a conventional squealer tip.
Figure 4B:
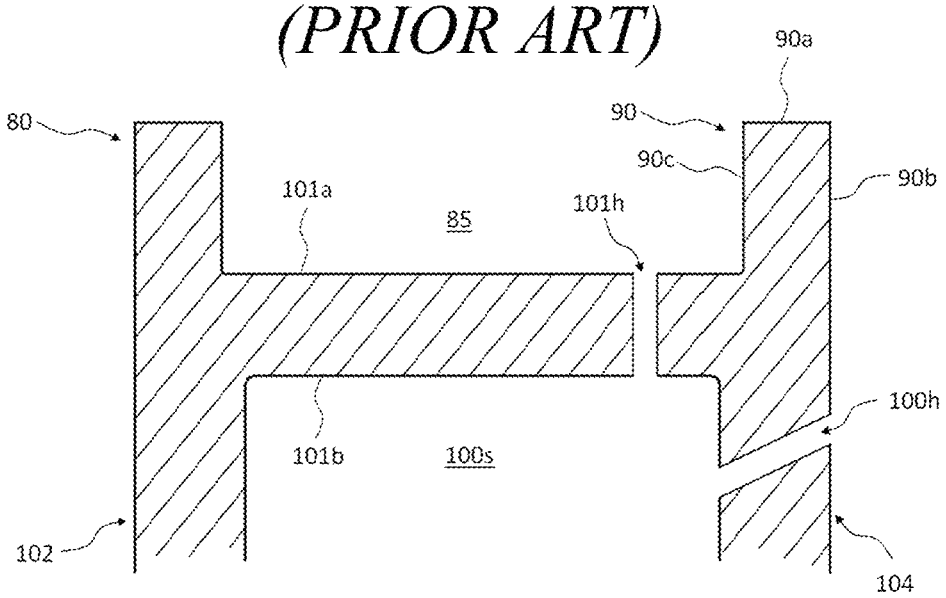
FIG. 4B (PRIOR ART)
FIG. 4B schematically depicts a cross-sectional view of the conventional airfoil with the conventional squealer tip of FIG. 4A along the line I-I of FIG. 4A.

Hereinafter, the blade 1 according to the present technique has been explained with reference to the exemplary embodiments depicted in FIG. 5A to FIG. 16. FIGS. 4A and 4B represent a conventional blade for comparative understanding of the present technique.

Figure 5A:
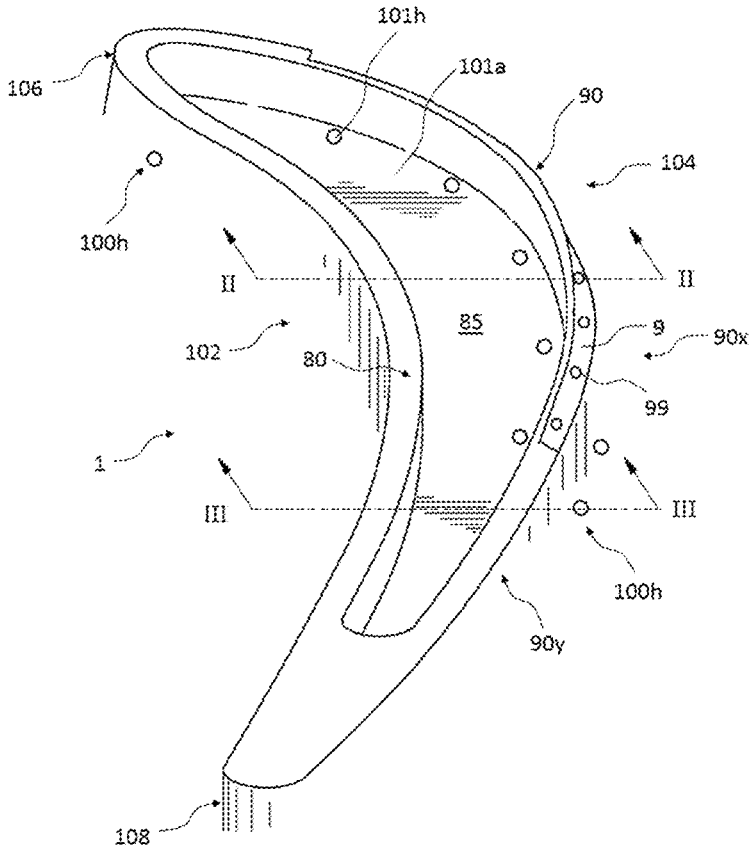
FIG. 5A schematically depicts a perspective view of an exemplary airfoil with a squealer tip of the present technique.

As shown in FIGS. 5A, the squealer tip 80, 90 may be generally shaped as a rail encircling, continuously or intermittently (not shown), along a periphery of airfoil tip part 100*a*.

The squealer tip 80, 90 includes a suction side rail 90. The suction side rail 90 may be positioned at and extending along a periphery of the suction side 104 at the outer surface 101*a* of the airfoil tip part 100*a*.

Optionally, the squealer tip 80, 90 may include a pressure side rail 80 positioned at and extending along a periphery of the pressure side 102 at the outer surface 101*a* of the airfoil tip part 100*a*.

As depicted in FIG. 3, a radial clearance G1 between a surface 42*a* of the stator and the suction side rail 90 is lesser than a radial clearance G2 between the surface 42*a* of the stator and the outer surface 101*a* of the airfoil tip part 100*a*.

A squealer tip pocket 85 (shown in FIG. 5B) may be formed at the outer surface 101*a* of the airfoil tip part 100*a* defined by the suction side rail 90 and/or the pressure side rail 80.

Figure 5B:
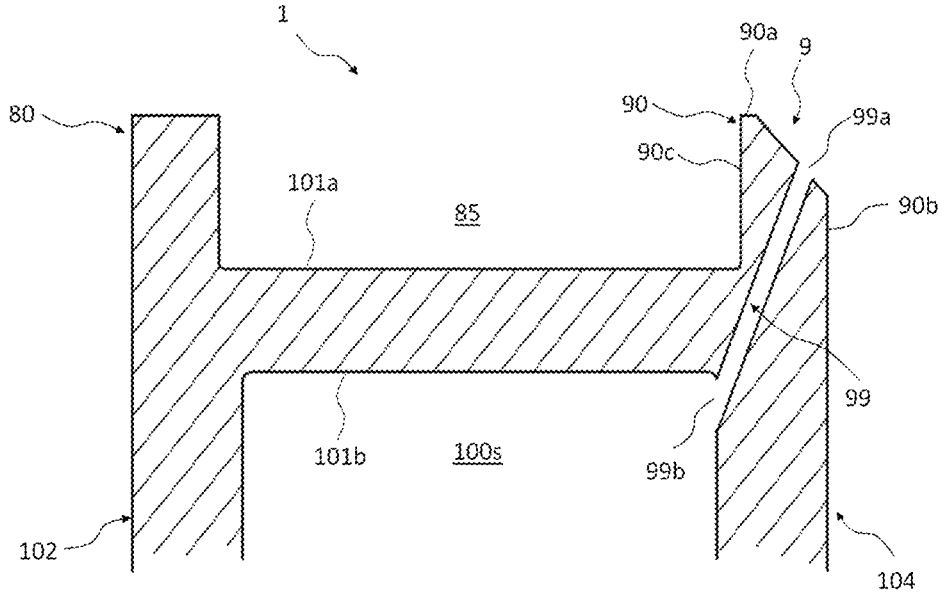
FIG. 5B schematically depicts a cross-sectional view of the airfoil with the squealer tip of FIG. 5A along the line II-II of FIG. 5A.

As can be seen from FIGS. 5A and 5B depicting an exemplary embodiment of the blade 1 of the present technique, in comparison to a conventional blade shown in FIGS. 4A and 4B, the blade 1 of the present technique differs from the conventionally known blade in the fact that the suction side rail 90 in the blade 1 includes a chamfer part 90*x* and at least one squealer tip cooling hole 99. It may be noted that such chamfer part 90*x* with at least one squealer tip cooling hole 99, in accordance with aspects of the present technique, is assumed to be present in FIG. 3, although not depicted in FIG. 3 for sake of simplicity.

The chamfer part 90*x* includes a chamfer surface 9. An outlet 99*a* of the at least one squealer tip cooling hole 99 is disposed at, i.e. opens at, the chamfer surface 9. In other words, the outlet 99*a* of the at least one squealer tip cooling hole 99 is spatially limited within the chamfer surface 9.

The squealer tip cooling hole 99 may be understood as a cooling air flow channel or through-hole at least partially, and preferably completely embedded within the suction side rail 90, and optionally a part embedded within the suction side wall 104 of the airfoil 100. Only the outlet 99*a* of the squealer tip cooling hole 99 may be positioned at an outer surface of the suction side rail 90 i.e. at the chamfer surface 9.

An inlet 99*b* of the squealer tip cooling hole 99 may not be positioned at any surface of the suction side rail 90.

The inlet 99*b* of the squealer tip cooling holes 99 may be in fluid communication with the airfoil cavity 100*s* i.e. with the internal space 100*s* of the airfoil 100 into which cooling air flows. In other words, the inlet 99*b* of the squealer tip cooling holes 99 may be disposed at the airfoil cavity 100*s*.

The cooling air may flow into the airfoil cavity 100*s* through one or more cooling channels formed in the root 300 (as shown in FIG. 2) of the blade 1 and/or the platform 200 (as shown in FIGS. 2 and 3) of the blade 1. The cooling air then may flow through one or more flow channels (not shown) that may be formed within the airfoil cavity 100*s*, and then enter the squealer tip cooling hole 99 via the inlet 99*b* of the squealer tip cooling hole 99. The cooling air while flowing through the squealer tip cooling hole 99 performs heat exchange with surfaces that define the squealer tip cooling hole 99, and thereby cooling the suction side rail 90 of the squealer tip. Thereafter, the cooling air exits the squealer tip cooling hole 99 via the outlet 99*a* of the squealer tip cooling hole 99 formed or disposed or positioned at the chamfer surface 9 of the chamfer part 90*x* of the suction side rail 90 of the squealer tip 80, 90.

In short, the cooling air flowing through the squealer tip cooling hole 99 cools the squealer tip, particularly cools the suction side rail 90 of the squealer tip.

Due to the chamfer surface 9 and because the outlet 99*a* of the at least one squealer tip cooling hole 99 is located at the chamfer surface 9, even when there is rub event between the squealer tip 90 and a surface of the stator facing the squealer tip 90, for example the surface 42*a* (shown in FIG. 3) e.g. an inner surface of the turbine casing or a stator shroud attached to the turbine casing and facing the turbine blade 1, the outlets 99*a* of the squealer tip cooling holes 99 that are positioned at the chamfer surface 9 are not blocked. Thus, efficient cooling of the squealer tip i.e. of the suction side rail 90, and thus of the blade tip, may be achieved without requiring an increase in the rub tolerance i.e. in radial clearance G1 between the suction side rail 90 of the squealer tip and the surface 42*a* of the stator facing the squealer tip.

A height, measured along the axis R shown in FIG. 2 from the outer surface 101*a* of the airfoil tip part 100*a*, of the suction side rail 90 may be between 1% and 10%, and preferably between 1.5% and 4% of a height of the airfoil 100, measured along the axis R shown in FIG. 2 from the platform 200.

The radial clearance G1 between the suction side rail 90 of the squealer tip and the surface 42*a* of the stator facing the squealer tip may be between 0.5% and 5%, and preferably between 0.5% and 2% of a height of the airfoil 100, measured along the axis R shown in FIG. 2 from the platform 200.

As shown in FIG. 5A, the at least one squealer tip cooling hole 99 may include a plurality of squealer tip cooling holes 99 for example between 1 and 50 squealer tip cooling holes 99, and preferably between 5 and 20 squealer tip cooling holes 99. The outlets 99*a* of all of the plurality of the squealer tip cooling holes 99 may be positioned at the chamfer surface 9.

As shown in FIGS. 5A and 5B, the suction side rail 90 may extend along the suction side 104 of the airfoil 100 i.e. in other words parallel to an upper edge, i.e. radially outward edge with respect to the direction R shown in FIG. 2, of the outer surface of the suction side 104.

The suction side rail 90 may be positioned at the upper edge, radially outward edge with respect to the direction R shown in FIG. 2, of the outer surface of the suction side 104.

An outer peripheral surface 90*b* of the suction side rail 90 may be flush with the outer surface of the suction side 104.

As shown in FIG. 5A, a shape of suction side rail 90, in a direction between the leading and the trailing edges 106, 108, may correspond to a shape the outer surface of the suction side 104, in the direction between the leading and the trailing edges 106, 108.

The suction side rail 90 may extend continuously between the leading edge 106 and the trailing edge 108.

The suction side rail 90 may have a same length as that of the upper edge, radially outward edge, of the outer surface of the suction side 104.

As can be seen from FIG. 5B, the suction side rail 90 may comprise an inner peripheral surface 90*c*, an outer peripheral surface 90*b* and an upper surface 90*a*.

The inner peripheral surface 90*c* may be adjacent to or contiguous with the squealer tip pocket 85 defined by the suction side rail 90 at the outer surface 101*a* of the airfoil tip part 100*a*, i.e. over or above the airfoil tip part 100*a*.

The outer peripheral surface 90*b* may be adjacent to the suction side 104 of the airfoil 100.

The outer peripheral surface 90*b* and the inner peripheral surface 90*c* may be opposite to each other.

The upper surface 90*a* may connect the outer and the inner peripheral surfaces 90*c*,90*b*. The upper surface 90*a* may be the radially outermost surface of the suction side rail 90 and/or the blade 1.

As shown in FIG. 5B, the chamfer surface 9 may extend between the upper surface 90*a* and the outer peripheral surface 90*b*. In other words, the chamfer surface 9 may be formed at a surface of the suction side rail 90 that is contiguous with the suction side 104, particularly an outer surface of the suction side 104.

The chamfer surface 9 may be a beveled edge (not shown) i.e. the chamfer surface 9 may extend from the outer surface of the suction side 104 of the airfoil 100 upto the upper surface 90*a*, i.e. an uppermost surface, of the suction side rail 90.

Figure 16:
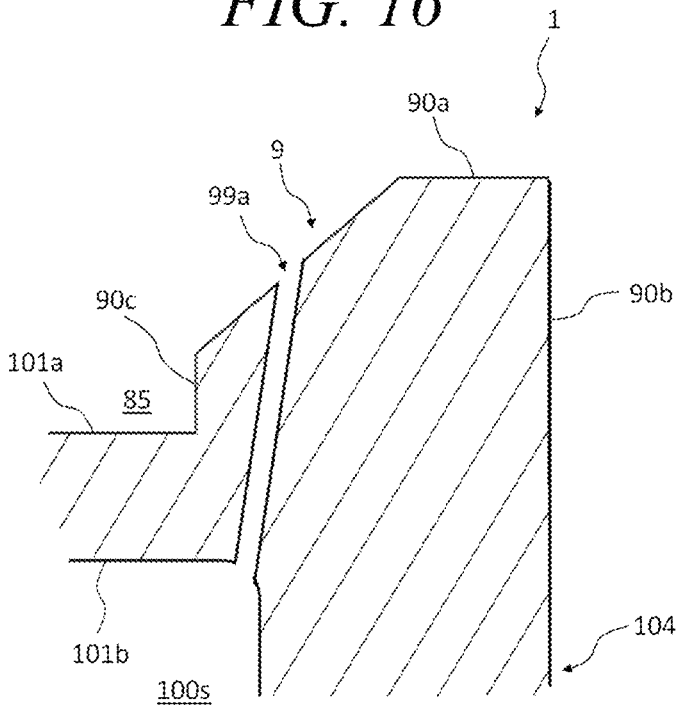
FIG. 16 schematically depicts a cross-sectional view of yet another exemplary airfoil with the squealer tip of the present technique.

Alternatively, as shown in FIG. 16, the chamfer surface 9 may extend between the upper surface 90*a* and the inner peripheral surface 90*c*. In other words, the chamfer surface 9 may be formed at a surface of the suction side rail 90 that is contiguous with the outer surface 101*a* of the airfoil tip part 100*a*. To explain further, the chamfer surface 9 may be formed at a surface of the suction side rail 90 that defines the squealer tip pocket 85 at the upper surface or outer surface 101*a* of the airfoil tip part 100*a* or wall 100*a*.

The chamfer surface 9 may be a beveled edge (not shown) i.e. the chamfer surface 9 may extend from the outer surface 101*a* of the airfoil tip part 100 upto the upper surface 90*a*, i.e. an uppermost surface, of the suction side rail 90.

In another exemplary embodiment (not shown), the suction side rail 90 may comprise a first chamfer surface 9 comprising at least one outlet 99*a* as explained hereinabove with reference to FIG. 5B and a second chamfer surface 9 comprising at least one outlet 99*a* as explained hereinabove with reference to FIG. 16.

Figure 6:
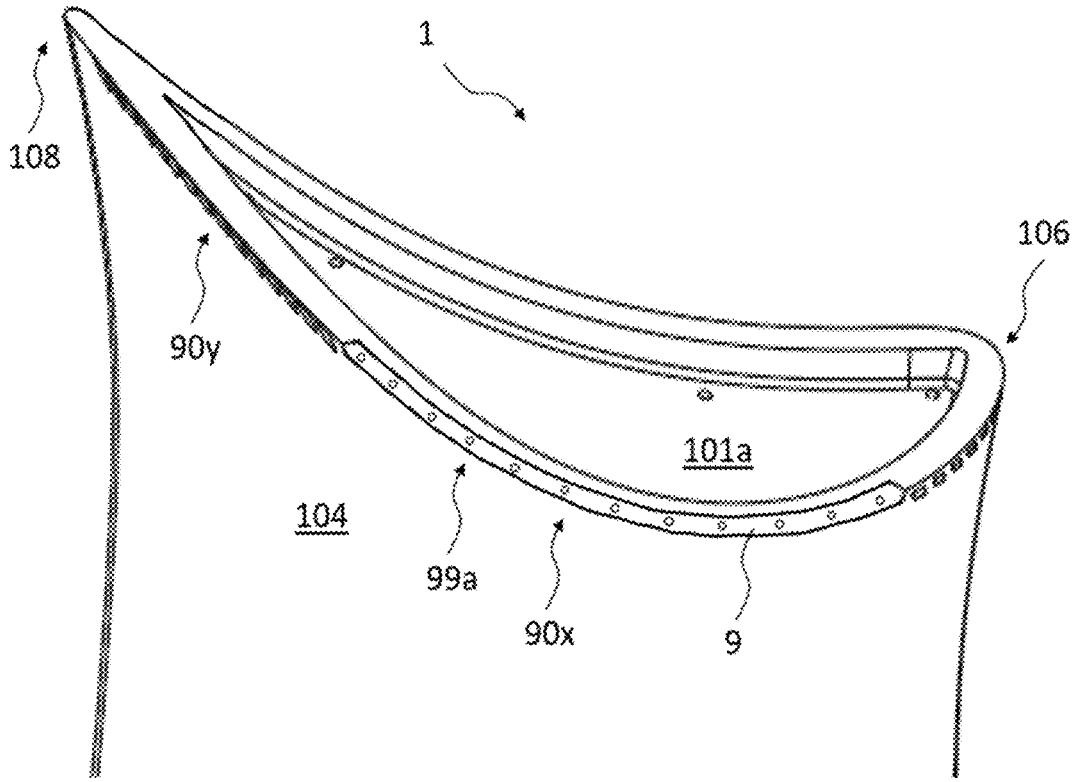
FIG. 6 schematically depicts another perspective view an exemplary airfoil with the squealer tip of the present technique.

Referring to FIG. 5A or FIG. 6, the suction side rail 90 may include at least one non-chamfer part 90*y* i.e. a part of the suction side rail 90 without the chamfer part 9. A cross-section at the non-chamfer part 90*y* at the line of FIG. 5A may be same as depicted in FIG. 4B.

Alternatively (not shown), the suction side rail 90 may not include any non-chamfer part 90*y* i.e. the chamfer part 9 may extend along the entire length of the suction side rail 90. In such embodiment a cross-section at any position of the suction side rail 90 may be similar to FIG. 5B with respect to the chamfer surface 9.

Figure 14A:
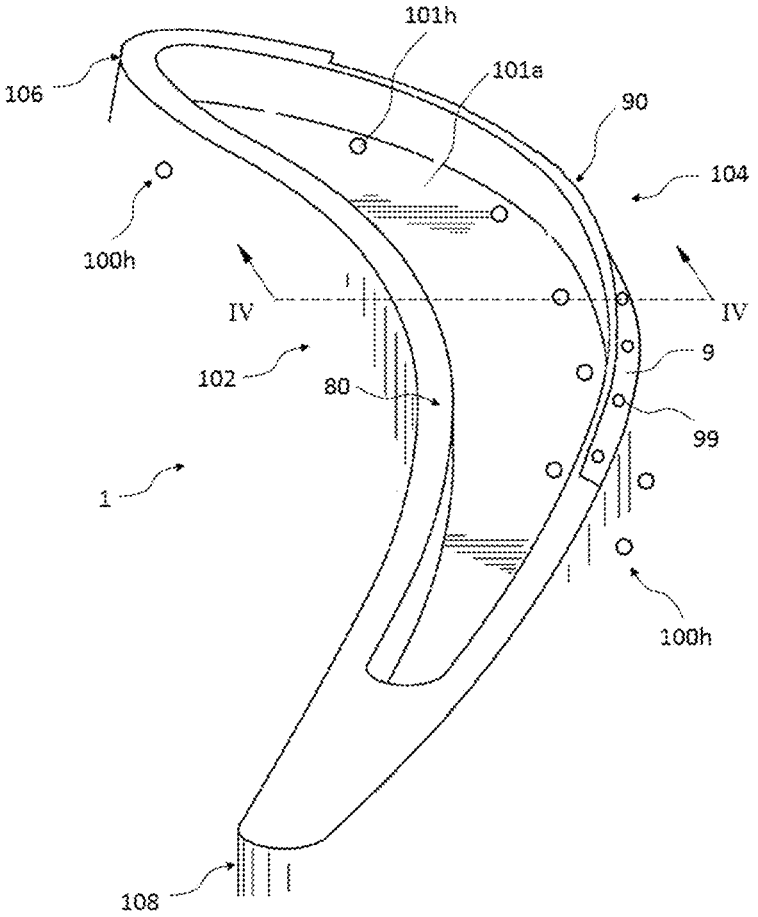
FIG. 14A schematically depicts a perspective view of yet another exemplary airfoil with a squealer tip of the present technique.
Figure 14B:
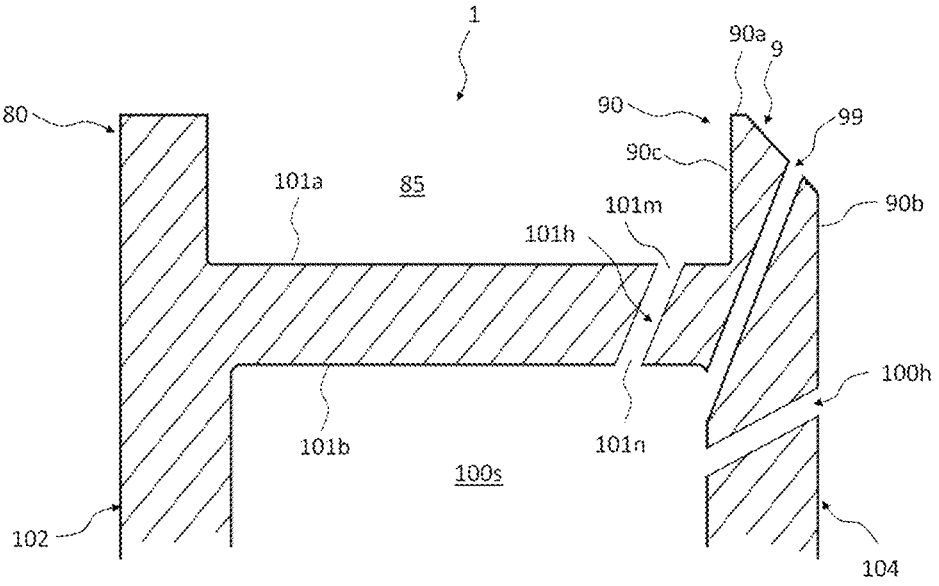
FIG. 14B schematically depicts a cross-sectional view of the airfoil with the squealer tip of FIG. 14A along the line IV-IV of FIG. 14A.

As shown in FIG. 5A and also as depicted in FIGS. 14A and 14B, the blade 1 of the present technique may also include one or more airfoil side wall cooling holes 100*h*. The airfoil side wall cooling holes 100*h* may fluidly communicate the airfoil cavity 100*s* with an outer surface of the airfoil 100, for example an outer surface of the suction side 104 of the airfoil 100.

As shown in FIG. 5A and also as depicted in FIGS. 14A and 14B, the blade 1 of the present technique may also include one or more airfoil tip wall cooling hole 101*h*. The airfoil tip wall cooling holes 101*h* may fluidly communicate the airfoil cavity 100*s* with the outer surface 101*a* of the airfoil tip 100*a*. As shown in FIG. 14B, according to the present technique, an outlet 101*m* of the airfoil tip wall cooling hole 101*h* may be positioned at the upper surface 101*a* of the airfoil tip part 100*a* and may be directed towards the suction side rail 90. In other words, the airfoil tip wall cooling hole 101*h* may be configured to direct cooling air towards the suction side rail 90, preferably towards the inner peripheral surface 90*c* of the suction side rail 90.

Hereinafter, with reference to FIGS. 8A and 8B different exemplary embodiments of the chamfer surface 9 according to the present technique are explained.

Figure 8A:
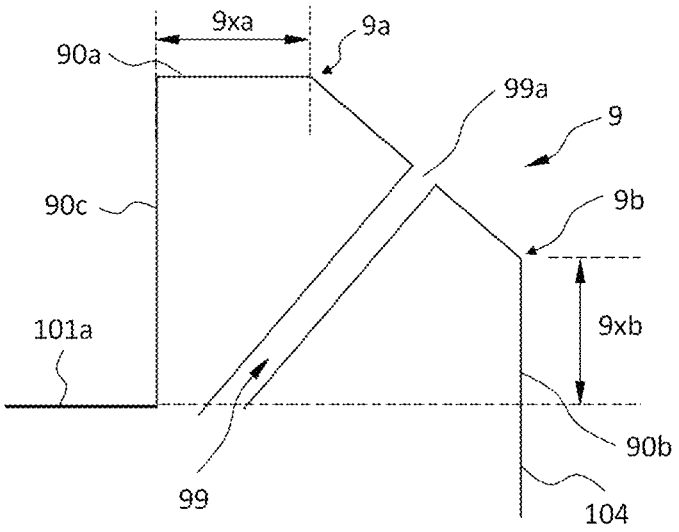
FIG. 8A-B schematically depict different exemplary embodiments of a chamfer surface according to the present technique.

FIG. 8A depicts a flat chamfer surface 9, i.e. the chamfer surface 9 has a cross-section, e.g. a vertical cross-section, having a straight line extending between the upper and the lower peripheral edges 9*a*, 9*b*. In other words, the chamfer surface extends between the upper and the lower peripheral edges 9*a*, 9*b* along a straight line.

Figure 8B:
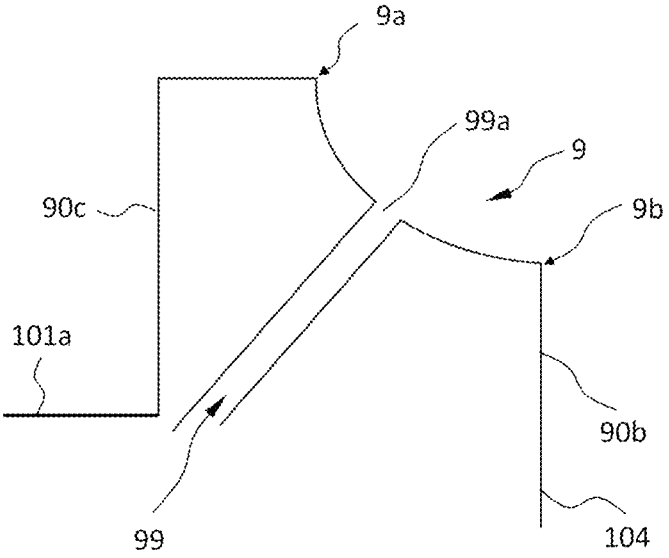

FIG. 8B depicts a curved chamfer surface 9 i.e. the chamfer surface 9 has a cross-section, e.g. a vertical cross-section, having a curved line extending between the upper and the lower peripheral edges 9*a*, 9*b*. In other words, the chamfer surface extends between the upper and the lower peripheral edges 9*a*, 9*b* along a curved line.

The phrase 'vertical cross-section' may mean a cross-section made by a plane extending between the suction side and the pressure side, preferably perpendicular to the chord of the airfoil.

Furthermore, as shown in FIG. 8B, the curved chamfer surface 9 may be inwardly curved or may have a concave shape, i.e. may be indented into the suction side rail 90. Due to inward curving, the outlets 99*a* of the squealer tip cooling hole 90 are further away from the surface 42*a* (in FIG. 3) of the stator facing the squealer tip that the suction side rail 90 may come into contact with during occurrence of a rub event, and hence chance of blocking of the outlets of the squealer tip cooling hole is further obviated.

Alternatively (not shown), the curved surface 9 may be outwardly curved or may have a convex shape, i.e. may be protruded out of the suction side rail 90. Due to outward curving, the length of the squealer tip cooling hole 99, i.e. a length of the hole within or embedded in the suction side rail 90 is further increased and thus cooling air flowing through or in the squealer tip cooling hole 99 flows over a larger distance while being in contact with the squealer tip cooling hole 99 and thus more efficiently cools the suction side rail 90.

Also, with reference to FIGS. 8A and 8B, and FIGS. 9A to 9G different exemplary embodiments of the squealer tip cooling hole 99 are explained.

FIGS. 8A and 8B depict a cylindrical hole. FIG. 6 shows the outlets 99*a* of the cylindrical squealer tip cooling holes 99 positioned at the chamfer surface 9 which may be flat or curved as shown in FIGS. 8A and 8B, respectively. In other words, a cross-section of the squealer tip cooling hole 99 from the inlet 99*b* of the squealer tip cooling hole 99 to the outlet 99*a* of the squealer tip cooling hole 99 may be constant. The cross-section may have, but not limited to, a circle shape, an oval shape, a semicircular shape, a polygonal shape.

Figure 9A:
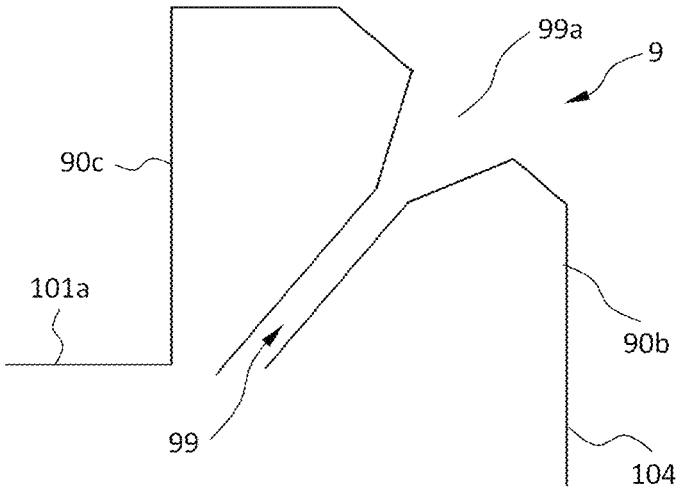
FIG. 9A-G schematically depict different exemplary embodiments of a squealer tip cooling hole according to the present technique.

FIG. 9A depicts a fan-shaped hole or funnel-shaped hole or countersunk hole. In other words, a cross-section of the squealer tip cooling hole 99 at the outlet 99*a* of the squealer tip cooling hole 99 may be greater than a cross-section of the squealer tip cooling hole 99 at a position other than the outlet 99*a* of the squealer tip cooling hole 90, for example at the inlet 99*b* of the squealer tip cooling hole 99 or at an intervening position between the outlet 99*a* and the inlet 99*b* of the squealer tip cooling hole 90.

The countersunk squealer tip cooling holes 99 may be a conical hole that enlarges another coaxial hole disposed therein.

Figure 7:
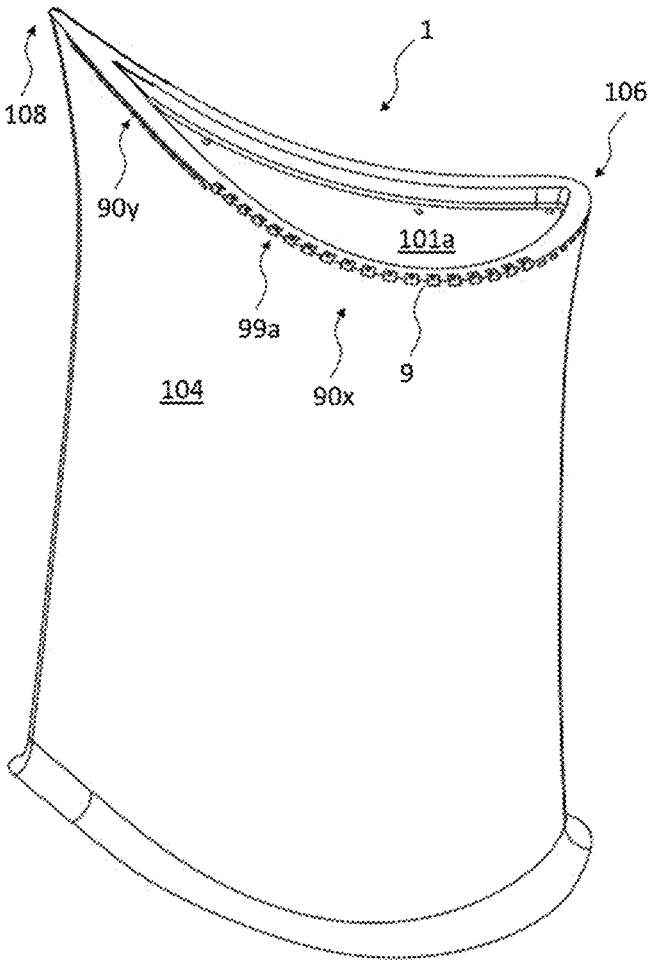
FIG. 7 schematically depicts a perspective view another exemplary airfoil with yet another exemplary squealer tip of the present technique.
Figure 9B:
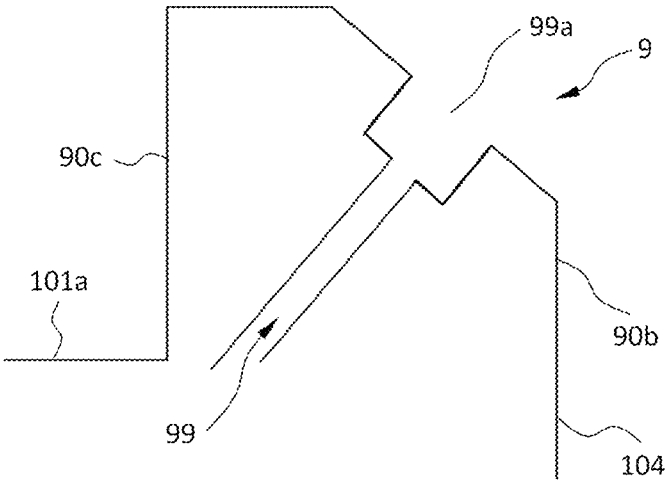

FIG. 9B depicts a counterbore hole. FIG. 7 shows the outlets 99*a* of the squealer tip cooling holes 99 positioned at the chamfer surface 9 which may be flat or curved as shown in FIGS. 8A and 8B, respectively. The squealer tip cooling holes 99 shown in FIG. 7 may be counterbore squealer tip cooling holes 99. The counterbore squealer tip cooling holes 99 may be a cylindrical flat-bottomed hole that enlarges another coaxial hole disposed therein.

Figure 9C:
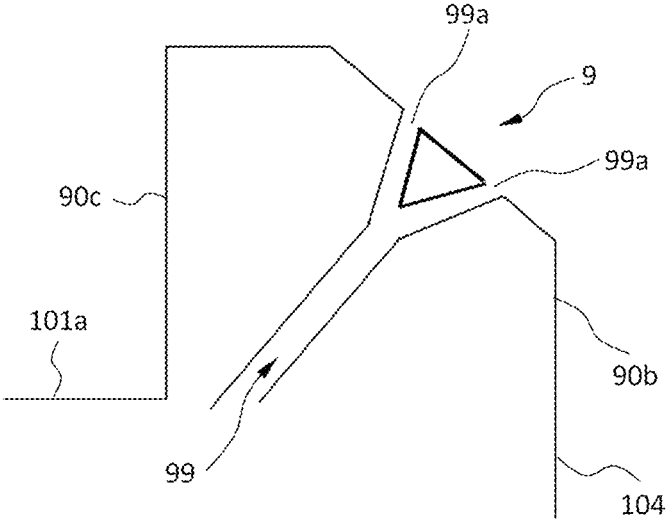

FIG. 9C depicts a branched hole. In other words, one branched squealer tip cooling hole 99 may have one inlet 99*b* and may branch into two or more branches each having an outlet 99*a*. Thus, one branched squealer tip cooling hole 99 may have one inlet 99*b* and two or more outlets 99*a*. The branches of the branched squealer tip cooling holes 99 may be cylindrical similar to the depiction of FIGS. 8A-8B and as depicted in FIG. 9C, fan-shaped hole or funnel-shaped hole or countersunk hole similar to the depiction of FIG. 9A, or counterbore hole similar to the depiction of FIG. 9B.

As shown in FIG. 9C, one or more, for e.g. a plurality of outlets 99*a*, of the two or more outlets 99*a* may be placed or positioned at the chamfer surface 9. Preferably, all of the outlets 99*a* of the branched squealer tip cooling hole 99 may be placed or positioned at the chamfer surface 9. Thus, more efficiently cooling the chamfer surface 9 and the suction side rail 90 due to increase in the flow distance within the suctions side rail 90.

Figure 9D:
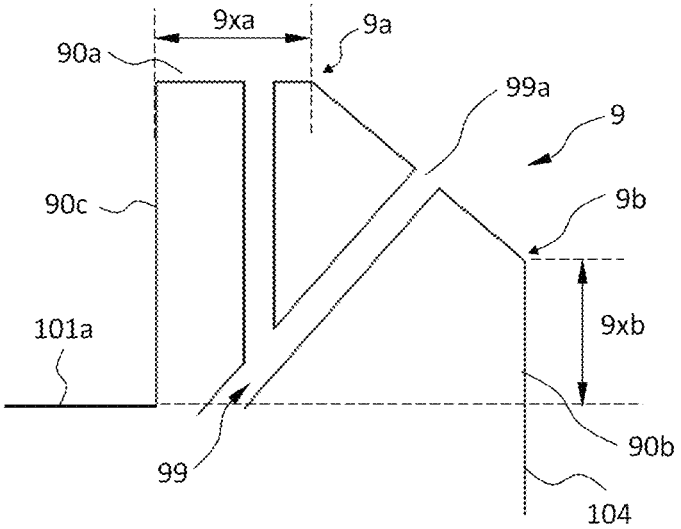
Figure 9E:
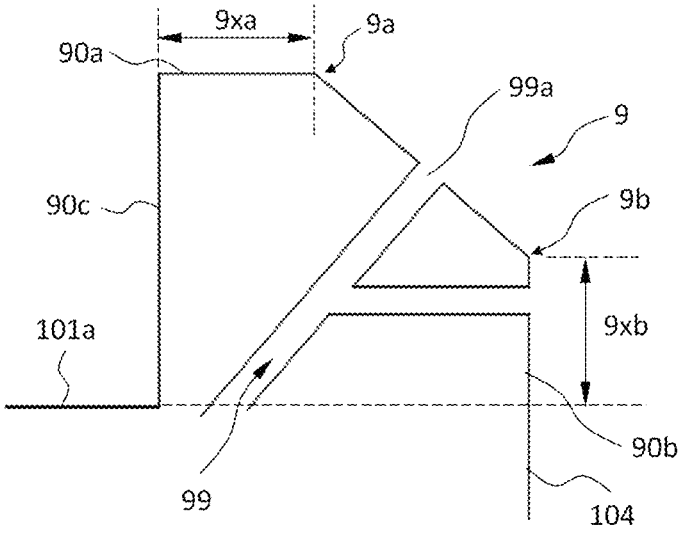

FIGS. 9D and 9E also depict various embodiments of a branched hole. One branched squealer tip cooling hole 99 may have one inlet 99*b* and may branch into two or more branches each having an outlet 99*a*. Thus, one branched squealer tip cooling hole 99 may have one inlet 99*b* and two or more outlets 99*a*. The branches of the branched squealer tip cooling holes 99 may be cylindrical similar to the depiction of FIGS. 8A-8B and as depicted in FIG. 9D, fan-shaped hole or funnel-shaped hole or countersunk hole similar to the depiction of FIG. 9A, or counterbore hole similar to the depiction of FIG. 9B.

As shown in FIG. 9D, one of the two or more outlets 99*a* may be placed or positioned at the chamfer surface 9, and another of the two or more outlets 99*a* may be placed or positioned at a surface other than or outside the chamfer surface 9, for example at the upper surface 90*a*. Alternatively or additionally, as shown in FIG. 9E, one of the two or more outlets 99*a* may be placed or positioned at the chamfer surface 9, and another of the two or more outlets

99*a* may be placed or positioned at a surface other than or outside the chamfer surface 9, for example at the outer peripheral surface 90*a*.

Simply put, at least one of the two or more outlets 99*a* of the branched squealer tip cooling hole 99 may be placed or positioned at the chamfer surface 9 while at least another one of the two or more outlets 99*a* of the branched squealer tip cooling hole 99 may be placed or positioned outside the chamfer surface 9 for example at a surface of the suction side rail 90 other than the chamfer surface 9 for example at one or more of the inner peripheral surface 90*c*, outer peripheral surface 90*b* and the upper surface 90*a*, within the chamfer part 90*x*. Thus, more efficiently cooling the chamfer surface 9 as well as surfaces 90*a*, 90*b*, 90*c* of the suction side rail 90 other than the chamfer surface 9.

Figure 9F:
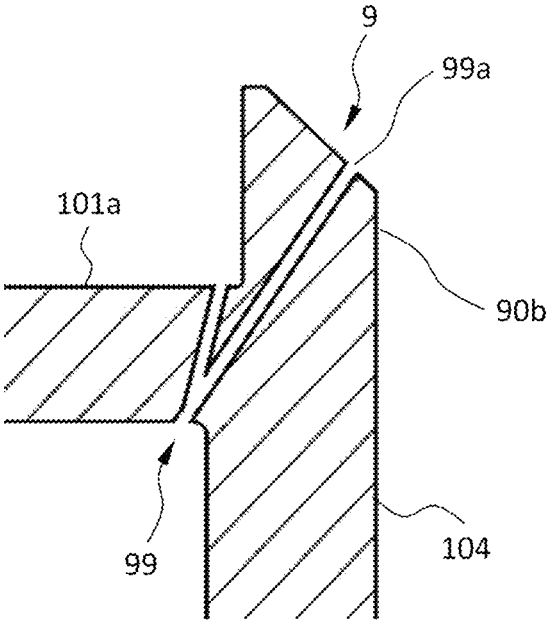

Furthermore, as shown in FIG. 9F, one or more, for e.g. a plurality of outlets 99*a*, of the two or more outlets 99*a* of the branched squealer tip cooling hole 99 may be placed or positioned at the chamfer surface 9 while one or more, for e.g. a plurality of outlets 99*a*, of the two or more outlets 99*a* of the branched squealer tip cooling hole 99 may be placed or positioned outside the chamfer part 90*x* for example in the non-chamfer part 90*y* and/or at the outer surface 101*a* of the airfoil tip part 100*a*. Thus, cooling the non-chamfer part 90*y* and/or the airfoil tip part 100*a* in addition to the chamfer part 90*x* of the suction side rail 90.

Optionally, the outlets 99*a*, of the two or more outlets 99 of the branched squealer tip cooling hole 99 that are placed or positioned at the outer surface 101*a* of the airfoil tip part 100*a* may face or be directed towards the suction side rail 90, and consequently may direct cooling air exiting therefrom towards the suction side rail 90.

Figure 9G:
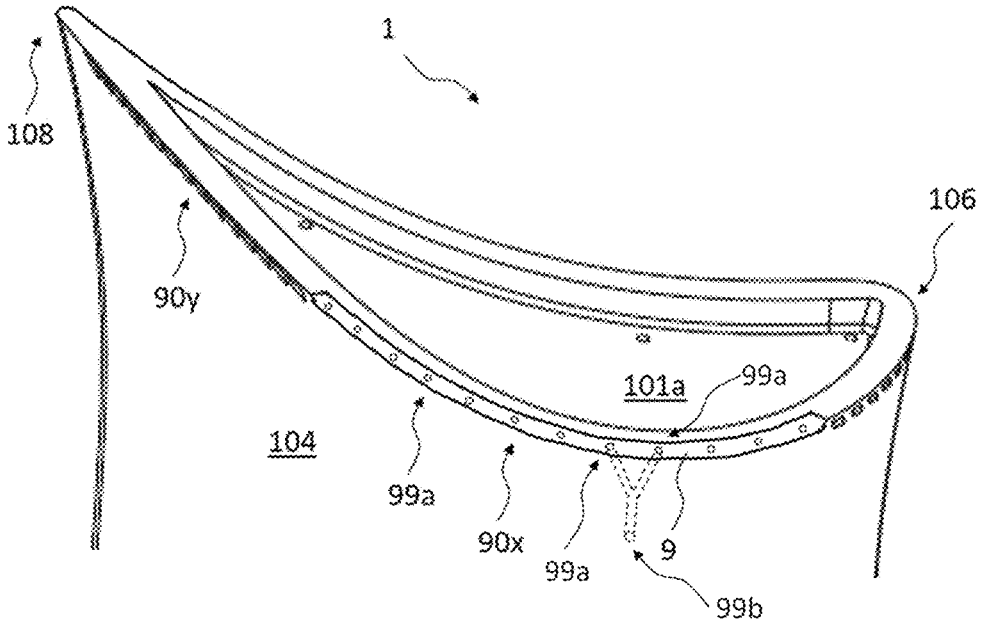

FIG. 9G depicts another example of a branched hole. In other words, one branched squealer tip cooling hole 99 may have one inlet 99*b* and may branch into two or more branches each having an outlet 99*a*. Thus, one branched squealer tip cooling hole 99 may have one inlet 99*b* and two or more outlets 99*a*. The branches of the branched squealer tip cooling holes 99 may be cylindrical similar to the depiction of FIGS. 8A-8B and as depicted in FIG. 9C, fan-shaped hole or funnel-shaped hole or countersunk hole similar to the depiction of FIG. 9A, or counterbore hole similar to the depiction of FIG. 9B.

As shown in FIG. 9G, a plurality of outlets 99*a*, of the two or more outlets 99*a* may be placed or positioned at the chamfer surface 9. Preferably, all of the outlets 99*a* of the branched squealer tip cooling hole 99 may be placed or positioned at the chamfer surface 9. The outlets 99*a* positioned at the chamfer surface 9 may be spaced apart along chordwise direction of the airfoil.

Generally, the inlet 99*b* of the squealer tip cooling hole 99, for example for the squealer tip cooling hole 99 shown in FIGS. 8A-8B and in FIGS. 9A-9G may be placed at the airfoil cavity 100*s* or may be in fluid communication with the airfoil cavity 100*s*, such that cooling air in the airfoil cavity 100*s* may flow into the squealer tip cooling hole 99, via the inlet 99*b*. The cooling air may be provided to the airfoil cavity 100*s* by a variety of ways, for example through the blade platform or root. The cooling air may be provided from the compressor of the gas turbine.

A diameter of the inlet 99*b* may be equal to or smaller than a diameter of the outlet 99*a* or outlets 99*a* of squealer tip cooling hole 99.

Alternatively, the diameter of the inlet 99*b* may be equal to or greater than the diameter of the outlet 99*a* or outlets 99*a* of squealer tip cooling hole 99.

Hereinafter with reference to FIG. 10, exemplary position/orientation of the chamfer part 90*x* at the suction side rail 90 are explained.

Figure 10:
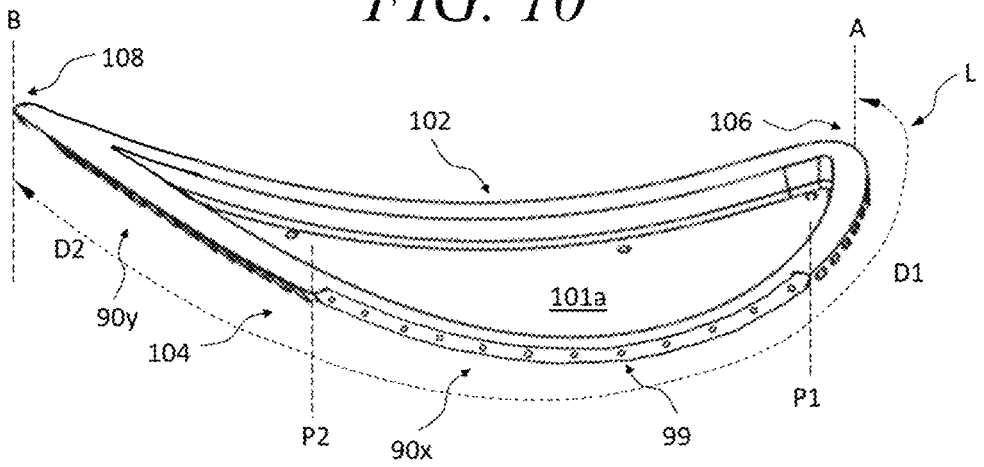
FIG. 10 schematically illustrates exemplary positioning of a chamfer part of the present technique.

As stated earlier, although not shown in FIG. 10, the chamfer part 90*x* may extend along the entire length of the suction side rail 90, i.e. there may not be any non-chamfer part 90*y*.

However, as shown in FIG. 10, the chamfer part 90*x* may extend from a first position P1 to a second position P2 along the suction side rail 90. The first position P1 may be at a first distance D1 from the leading edge 106, i.e. from a position A of the leading edge 106. The second position P2 may be at a second distance D2 from the trailing edge 108 i.e. from a position B of the trailing edge 108. A distance between the leading edge 106 and the trailing edge 108 along the outer surface of the suction side 104 is represented by reference sign L in FIG. 10, and may be referred to as the length of the suction side 104.

The position A of or at the leading edge 106 may be understood as a touch point of the airfoil leading edge with a plane at 90° to engine axis. The position A may be located at the airfoil tip part 101*a*. The position A of the leading edge 106 may be understood as a point or position or location at which the leading edge 106 has a maximum curvature or in other words has minimum radius.

The position B of the trailing edge 108 may be understood as a point or position or location at which the trailing edge 108 has a maximum curvature or in other words has minimum radius. The position B may be located at the airfoil tip part 101*a*.

The first distance D1, the second distance D2 and the distance L between the leading edge 106 and the trailing edge 108 may be measured along an outer edge of the airfoil tip part 101*a* at the suction side 104, or in other words may be measured along the outer surface of the suction side 104.

The first distance D1 may be less than or smaller than the second distance D2. In other words, the chamfer part 90*x* may be closer to the leading edge 106 than to the trailing edge 108, when measured along the outer surface of the suction side 104.

The first distance D1 may be greater than or larger than the second distance D2. In other words, the chamfer part 90*x* may be closer to the trailing edge 108 than to the leading edge 106, when measured along the outer surface of the suction side 104.

The first distance D1 may be between 10 percent and 80 percent, preferably between 10 percent and 40 percent and more preferably 20 percent of the length L of the suction side 104. The length L may be measured along upper edge, i.e. radially outward edge of the outer surface of the suction side 104 i.e. measured along the tip part 100*a* of the airfoil 100. The second distance D2 may be between 10 percent and 80 percent, preferably between 20 percent and 60 percent and more preferably 40 percent of the length L of the suction side 104.

In a preferred embodiment the first distance D1 may be 20 percent and the second distance may be 40 percent of the length L of the suction side 104.

A length of the chamfer part 90*x* may be same as the length L of the suction side 104.

Alternatively, the length of the chamfer part 90*x* may be less than or smaller than the length L of the suction side 104. For example, the length of the chamfer part 90*x* may be between 10 percent to 90 percent of the length L of the suction side 104, preferably the length of the chamfer part 90*x* may be between 30 percent to 70 percent of the length L of the suction side 104.

In a preferred embodiment the length of the chamfer part 90*x* may be between 40 percent and 50 percent of the length L of the suction side 104.

Furthermore, as shown in FIG. 10 and also previously in FIGS. 5A, 6 and 7, the suction side rail 90 may comprise at least one non-chamfer part 90*y* adjacent to the chamfer part 90*x*.

The non-chamfer part 90*y*, e.g. a first non-chamfer part 90*y*, may extend between the chamfer part 90*x* and the leading edge 106. For example, the first non-chamfer part 90*y*, may extend between the first position P1 of the chamfer part 90*x* and the leading edge 106.

The non-chamfer part 90*y*, e.g. a second non-chamfer part 90*y*, may extend between the chamfer part 90*x* and the trailing edge 108. For example, the second non-chamfer part 90*y*, may extend between the second position P2 of the chamfer part 90*x* and the trailing edge 108.

Figure 11:
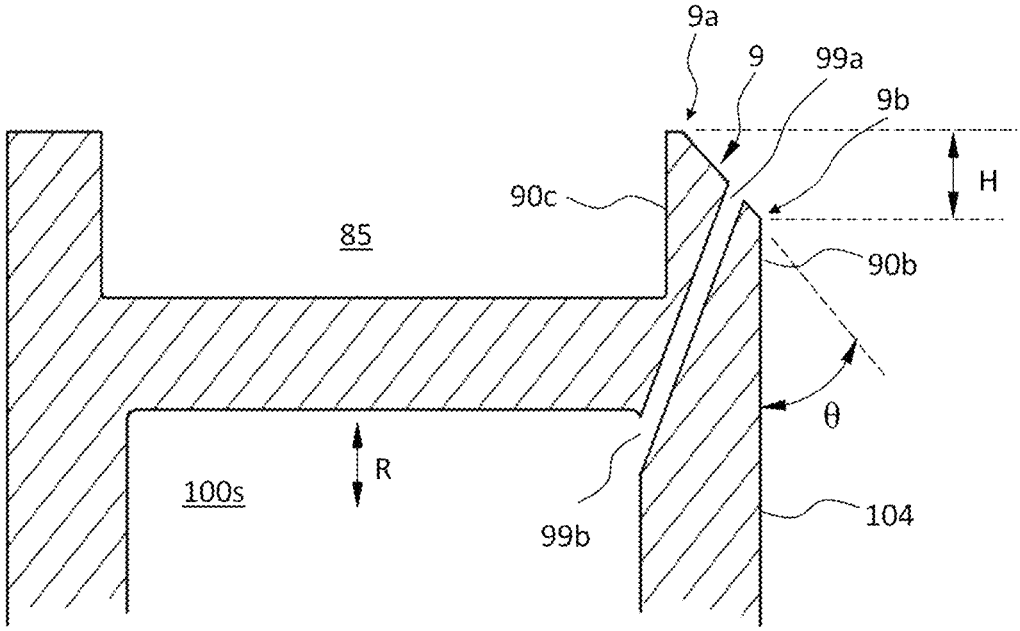
FIG. 11 schematically illustrates exemplary dimensions of the chamfer surface of the present technique.

Hereinafter with reference to FIG. 11, exemplary dimensions of the chamfer surface 9 are explained.

A height H of the chamfer surface 9 along the radial direction R (as shown also in FIG. 2) of the blade 1, i.e. measured in a direction vertical to the blade platform 200 (shown in FIGS. 2 and 3) or the airfoil tip part 101*a*, may be between 1 mm (millimeter) and 15 mm, and preferably between 2 mm and 3 mm.

An angle θ between the chamfer surface 9 and the suction side 104, i.e. the outer surface of the suction side 104, may be between 5 degree and 75 degree, and preferably between 30 degree and 60 degree.

A size of the outlets 99*a*, for example a diameter of the outlet 99*a* of the squealer tip cooling hole 99 may be between 0.1 mm and 1.5 mm, and preferably between 0.7 mm and 1 mm.

Above-mentioned sizes may apply when the squealer tip cooling hole is a cylindrical hole. Above-mentioned sizes may also apply when the squealer tip cooling hole is a branched hole with cylindrical branches.

Above-mentioned sizes may also apply to the cylindrical part of the hole in case of a fan-shaped hole and/or a counterbore hole, and the outlets of such holes may be larger than above-mentioned sizes. In other words, the above-mentioned sizes may apply from the inlet of the hole to the beginning of the expanded part of the hole at the outlet of the hole, e.g. in case of the fan-shaped hole and/or the counterbore hole.

Hereinafter, with reference to FIG. 12, in comparison with FIGS. 6 and 7, further exemplary embodiments of the chamfer part 90*x* are explained.

As shown in FIG. 6, the chamfer part 90*x* may be formed continuously i.e. as an integral structure. In other words, the suction side rail 90 may comprise only one chamfer part 90*x*. The only one chamfer part 90*x* may extend along the entire length of the suction side rail 90 or may be flanked at one or both sides by non-chamfer parts 90*y*.

Figure 12:
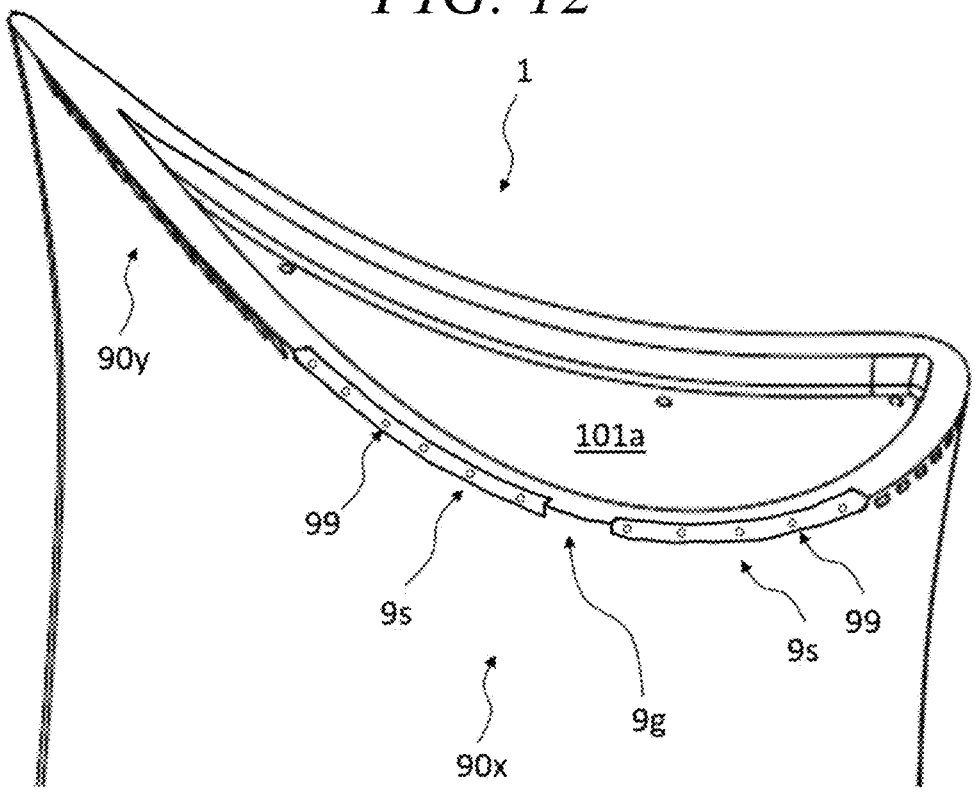
FIG. 12 schematically illustrates another exemplary embodiment of the chamfer part of the present technique.

Alternatively, as shown in FIG. 12, the chamfer part 90*x* may be formed intermittently. In other words, the chamfer part 90*x* may comprise a plurality of chamfer sub-parts 9*s*, and may be referred to as intermittent chamfer part 90*x*. The chamfer sub-parts 9*s* may be spaced apart from each other by a gap part 9*g*. The gap part 9*g* may be an unchamfered part of the suction side rail 90.

FIG. 7 also shows an intermittent chamfer part 90*x*, having a plurality of chamfer sub-parts 9*s* (not marked in FIG. 7) and in which each chamfer sub-parts 9*s* has one outlet 99*a* of the squealer tip cooling hole 99. In other words, each chamfer sub-part 9*s* may have one corresponding squealer tip cooling hole 99 and opening 99*a* of said squealer tip cooling hole 99 may open at the chamfer surface 9 of the chamfer sub-part 9*s*.

As shown in FIG. 12, each chamfer sub-part 9*s* may comprise the chamfer surface 9, i.e. part of the chamfer surface 9, and at least one squealer tip cooling hole 99. The outlet 99*a* of the at least one squealer tip cooling hole 99 of the chamfer sub-part 9*s* may be disposed at the chamfer surface 9 of the chamfer sub-part 9*s*.

Hereinafter, with reference to FIGS. 13A to 13C, further exemplary embodiments of placements of the outlet 99*a* of the at least one squealer tip cooling hole 99 at the chamfer surface 9 are discussed.

Figure 13A:
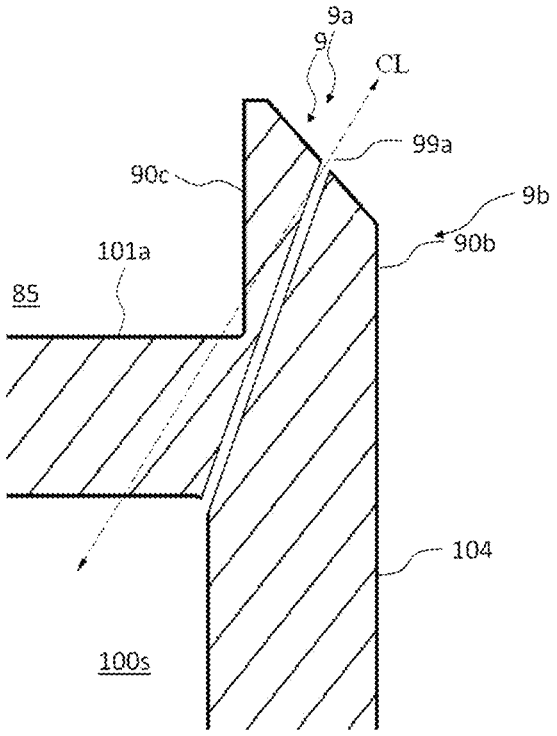
FIG. 13A-C schematically depict different exemplary positionings of an outlet of the squealer tip cooling hole according to the present technique.

As shown in FIG. 13A, the outlet 99*a* of the squealer tip cooling hole 99 may be centrally located between the upper peripheral edge 9*a* and the lower peripheral edge 9*b* of the chamfer surface 9. In FIG. 13A, the line CL shows a position of a line perpendicular to the chamfer surface 9 and which is equidistant from the upper peripheral edge 9*a* and the lower peripheral edge 9*b* of the chamfer surface 9. The outlet 99*a* of the squealer tip cooling hole 99 may be located such that the line CL passes through the outlet 99*a*. Preferably, the outlet 99*a* of the squealer tip cooling hole 99 is located at the chamfer surface 9 such that the line CL passes through the a center of the outlet 99*a* of the squealer tip cooling hole 99.

Figure 13B:
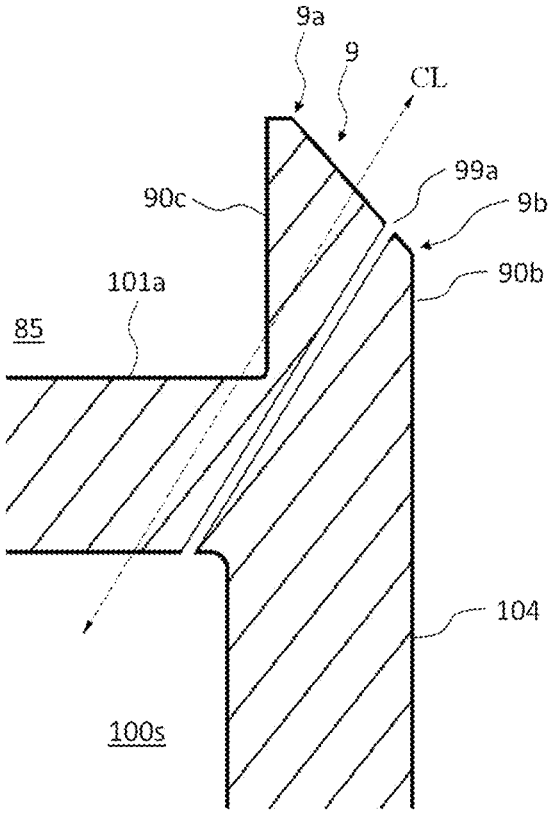

As shown in FIG. 13B, the outlet 99*a* of the squealer tip cooling hole 99 may be located closer to the lower peripheral edge 9*b* of the chamfer surface 9 than the upper peripheral edge 9*a* of the chamfer surface 9. In FIG. 13B, the line CL shows a position of a line perpendicular to the chamfer surface 9 and which is equidistant from the upper peripheral edge 9*a* and the lower peripheral edge 9*b* of the chamfer surface 9. The outlet 99*a* of the squealer tip cooling hole 99 may be located between the line CL and the lower peripheral edge 9*b* of the chamfer surface 9. Preferably, the outlet 99*a* of the squealer tip cooling hole 99 is located at the chamfer surface 9 such that the outlet 99*a* of the squealer tip cooling hole 99 is closer to the lower peripheral edge 9*b* of the chamfer surface 9 than to the line CL.

Figure 13C:
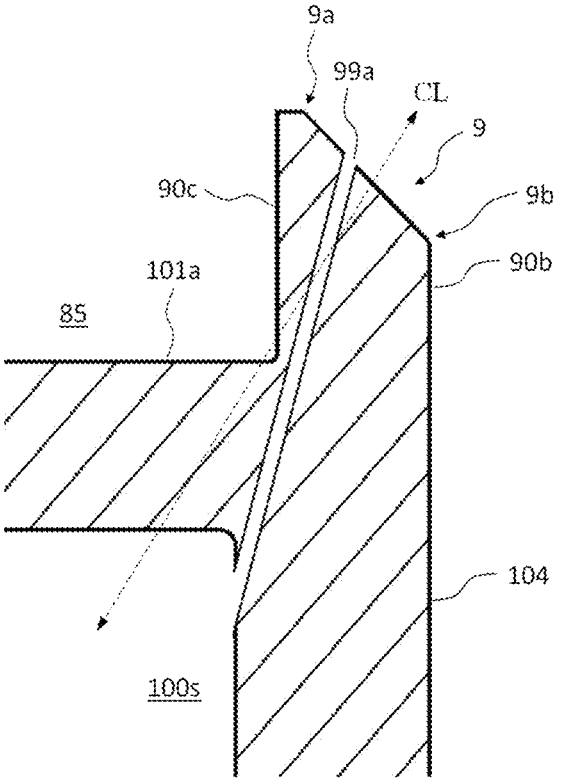

As shown in FIG. 13C, the outlet 99*a* of the squealer tip cooling hole 99 may be located closer to the upper peripheral edge 9*a* of the chamfer surface 9 than the lower peripheral edge 9*b* of the chamfer surface 9. In FIG. 13C, the line CL shows a position of a line perpendicular to the chamfer surface 9 and which is equidistant from the upper peripheral edge 9*a* and the lower peripheral edge 9*b* of the chamfer surface 9. The outlet 99*a* of the squealer tip cooling hole 99 may be located between the line CL and the upper peripheral edge 9*a* of the chamfer surface 9. Preferably, the outlet 99*a* of the squealer tip cooling hole 99 is located at the chamfer surface 9 such that the outlet 99*a* of the squealer tip cooling hole 99 is closer to the upper peripheral edge 9*a* of the chamfer surface 9 than to the line CL.

Hereinafter, with respect to FIG. 15, another exemplary embodiment of the blade 1 of the present technique is explained.

Figure 15:
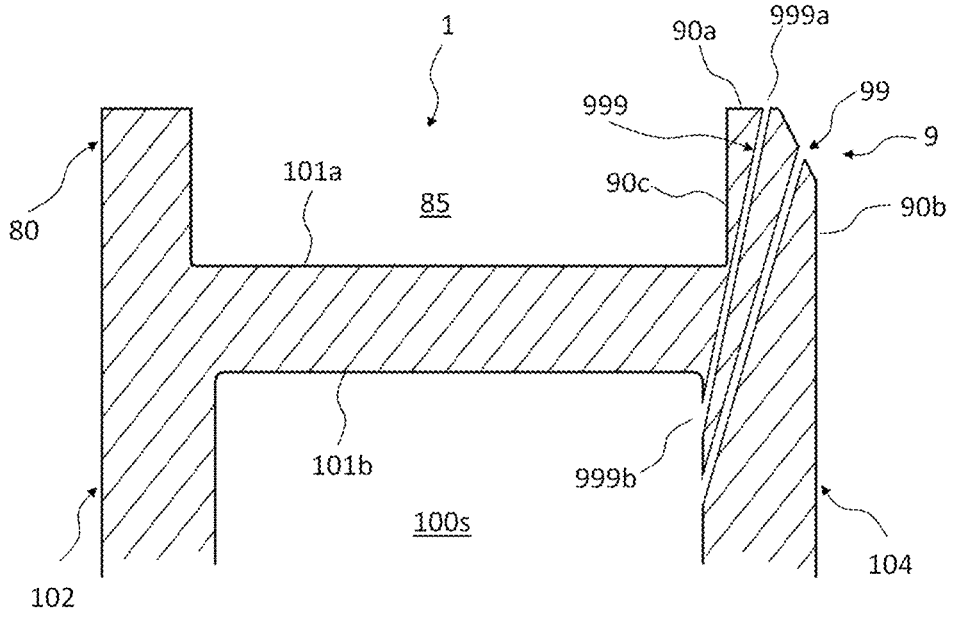
FIG. 15 schematically depicts a cross-sectional view of another exemplary airfoil with the squealer tip of the present technique.

As shown in FIG. 15, the suction side rail 90 may include at least one auxiliary squealer tip cooling hole 999.

An outlet 999*a* of the at least one auxiliary squealer tip cooling hole 999 may be disposed at a surface of the suction side rail 90 outside the chamfer surface 9.

The auxiliary squealer tip cooling hole 999 may be understood as a cooling air flow channel or through-hole at least partially, and preferably completely embedded within the suction side rail 90. Only the outlet 999*a* of the auxiliary squealer tip cooling hole 999 may be positioned at an outer surface of the suction side rail 90, for example at the outer peripheral surface 90*b* and/or at the inner peripheral surface 90*c* and/or at the upper surface 90*a* of the suction side rail 90.

The inlet 999*b* of the auxiliary squealer tip cooling hole 999 may be in fluid communication with the airfoil cavity 100*s* i.e. may be positioned at the airfoil cavity 100*s*. The inlet 999*b* of the auxiliary squealer tip cooling hole 999 may not be positioned at any outer surface of the suction side rail 90.

As shown in FIG. 15, the outlet 999*a* of the at least one auxiliary squealer tip cooling hole 999 may be disposed in the chamfer part 90*x* of the suction side rail 90.

Alternatively, the outlet 999*a* of the at least one auxiliary squealer tip cooling hole 999 may not be disposed in the chamfer part 90*x* of the suction side rail 90, but instead may be disposed at a part of the suction side rail 90 that is without chamfer surface 9 e.g. at the non-chamfer part 90 (shown in FIG. 5A, 6 or 7) or at the gap part 9*g* (shown in FIG. 12).

While the present technique has been described in detail with reference to certain embodiments, it should be appreciated that the present technique is not limited to those precise embodiments. Rather, in view of the present disclosure which describes exemplary modes for practicing the invention, many modifications and variations would present themselves, to those skilled in the art without departing from the scope of the appended claims. The scope of the invention is, therefore, indicated by the following claims rather than by the foregoing description. All changes, modifications, and variations coming within the meaning and range of equivalency of the claims are to be considered within their scope.

LIST OF REFERENCE SIGNS

1 Blade
9 chamfer surface
9*a* upper peripheral edge of the chamfer surface
9*b* lower peripheral edge of the chamfer surface
9*g* gap part between chamfer sub-parts
9*s* chamfer sub-parts
9*xa* distance between the chamfer surface and the inner peripheral surface of the suction side rail
9*xb* distance between the chamfer surface and the suction side
10 gas turbine engine
12 inlet
14 compressor section
16 combustor section or burner section
17 transition duct
18 turbine section
19 combustor cans
20 longitudinal or rotational axis
22 shaft
24 air
26 burner plenum
28 combustion chamber
30 burner
32 diffuser
34 combustion gas or working gas
36 blade carrying discs
38 turbine blades
40 guiding vanes
42 stator
42*a* inner surface of the stator
44 inlet guiding vanes
46 vane stages
48 rotor blade stages
50 casing
52 radially outer surface
53 rotor drum
54 radially inner surface
56 passage
80 pressure side squealer tip rail
85 squealer tip pocket
90 suction side squealer tip rail
90*a* upper surface of the suction side rail
90*b* outer peripheral surface of the suction side rail
90*c* inner peripheral surface of the suction side rail
90*x* chamfer part of the suction side rail
90*y* non-chamfered part of the suction side rail
99 squealer tip cooling hole
99*a* outlet of the squealer tip cooling hole
99*b* inlet of the squealer tip cooling hole
999 auxiliary squealer tip cooling hole
999*a* outlet of the auxiliary squealer tip cooling hole
999*b* inlet of the auxiliary squealer tip cooling hole
100 airfoil
100*a* airfoil tip part
100*b* airfoil base
100*h* airfoil side wall cooling hole
100*s* airfoil cavity
101*a* outer surface of the airfoil tip part/wall
101*b* inner surface of the airfoil tip part/wall
101*h* airfoil tip wall cooling hole
101*m* outlet of the airfoil tip wall cooling hole
101*n* inlet of the airfoil tip wall cooling hole
102 pressure surface/side
104 suction surface/side
106 leading edge
108 trailing edge
200 platform
201 upper surface of the platform
210 lower surface of the platform
300 root
A position of the leading edge
B position of the trailing edge
CL center line/plane of the chamfer surface
D1 first distance
D2 second distance
G1 clearance of the upper surface of the squealer tip
G2 clearance of the outer surface of the airfoil tip part
H height of the chamfer surface
L length between the positions A and B
P1 first position of the chamfer part
P2 second position of the chamfer part
R radial direction
θ angle of inclination of the chamfer surface

The invention claimed is:

1. A blade for a gas turbine, the blade comprising:

an airfoil having an airfoil tip part, and a pressure side and a suction side meeting at a leading edge and a trailing edge and defining an internal space of the airfoil; and a squealer tip arranged at the airfoil tip part, wherein the squealer tip comprises a suction side rail, wherein the suction side rail comprises:

an outer peripheral surface extending from the airfoil tip part in a longitudinal direction of the blade and flush with an outer surface of the suction side;

an inner peripheral surface extending from the airfoil tip part in the longitudinal direction of the blade and located opposite to the outer peripheral surface, wherein the outer peripheral surface and the inner peripheral surface are parallel to each other;

a chamfer part and at least one squealer tip cooling hole, wherein the chamfer part comprises a chamfer surface that a cross-section thereof is curved and wherein an outlet of the at least one squealer tip cooling hole is disposed at the chamfer surface; and an upper surface disposed immediately adjacent to either the outer peripheral surface or the inner peripheral surface.

2. The blade according to claim 1, wherein the chamfer surface extends between the upper surface and the outer peripheral surface.

3. The blade according to claim 1, wherein the chamfer surface extends between the upper surface and the inner peripheral surface.

4. The blade according to claim 1, wherein the chamfer surface comprises a thermal barrier coating.

5. The blade according to claim 1, wherein the squealer tip cooling hole is one of a cylindrical hole, a fan-shaped hole, a counterbore hole, and a branched hole.

6. The blade according to claim 1, wherein the chamfer part extends from a first position to a second position along the suction side rail, and wherein the first position is at a first distance from the leading edge and the second position is at a second distance from the trailing edge, and wherein the first distance is less than or greater than the second distance; and/or wherein the first distance is between 10 percent and 80 percent, preferably between 10 percent and 40 percent, and more preferably 20 percent, of a length of the suction side at the airfoil tip part of the airfoil; and/or wherein the second distance is between 10 percent and 80 percent, preferably between 20 percent and 60 percent, and more preferably 40 percent, of a length of the suction side at the airfoil tip part of the airfoil.

7. The blade according to claim 1, wherein the suction side rail comprises at least one non-chamfer part adjacent to the chamfer part; and wherein the non-chamfer part extends between the chamfer part and the leading edge, and/or wherein the non-chamfer part extends between the chamfer part and the trailing edge.

8. The blade according to claim 1, wherein a height of the chamfer surface along a radial direction of the blade is between 1 mm and 15 mm, and particularly between 2 mm and 3 mm; and/or wherein an angle between the chamfer surface and the suction side is between 5 degree and 75 degree, and particularly between 30 degree and 60 degree.

9. The blade according to claim 1, wherein the chamfer part comprises a plurality of chamfer sub-parts, and wherein the chamfer sub-parts are spaced apart from each other and a gap part of the suction side rail extends therein between, and wherein the gap part is unchamfered; and wherein each chamfer sub-part comprises the chamfer surface and at least one squealer tip cooling hole, and wherein an outlet of the at least one squealer tip cooling hole of chamfer sub-part is disposed at the chamfer surface of the chamfer sub-part.

10. The blade according to claim 1, wherein the chamfer surface has an upper peripheral edge and a lower peripheral edge, and wherein the outlet of the squealer tip cooling hole is centrally located between the upper peripheral edge and the lower peripheral edge.

11. The blade according to claim 1, wherein the chamfer surface has an upper peripheral edge and a lower peripheral edge, and wherein the outlet of the squealer tip cooling hole is located closer to the lower peripheral edge than the upper peripheral edge, or wherein the outlet of the squealer tip cooling hole is located closer to the upper peripheral edge than the lower peripheral edge.

12. The blade according to claim 1, further comprising at least one airfoil tip wall cooling hole and wherein an outlet of the airfoil tip wall cooling hole is positioned at an upper surface of the airfoil tip part and directed towards the suction side rail.

13. The blade according to any claim 1, wherein the suction side rail comprises at least one auxiliary squealer tip cooling hole, and wherein an outlet of the at least one auxiliary squealer tip cooling hole is disposed at a surface of the suction side rail outside the chamfer surface.

14. A turbine blade assembly comprising:

at least one blade and a rotor disk, wherein the at least one blade is coupled to the rotor disk, wherein the blade comprising:

an airfoil having an airfoil tip part, and a pressure side and a suction side meeting at a leading edge and a trailing edge and defining an internal space of the airfoil; and a squealer tip arranged at the airfoil tip part, wherein the squealer tip comprises a suction side rail, wherein the suction side rail comprises;

an outer peripheral surface extending from the airfoil tip part in a longitudinal direction of the blade and flush with an outer surface of the suction side;

an inner peripheral surface extending from the airfoil tip part in the longitudinal direction of the blade and located opposite to the outer peripheral surface, wherein the outer peripheral surface and the inner peripheral surface are parallel to each other;

a chamfer part and at least one squealer tip cooling hole, wherein the chamfer part comprises a chamfer surface that a cross-section thereof is curved and wherein an outlet of the at least one squealer tip cooling hole is disposed at the chamfer surface; and an upper surface disposed immediately adjacent to either the outer peripheral surface or the inner peripheral surface.

15. The turbine blade assembly according to claim 14, upper surface, and wherein the chamfer surface extends between the upper surface and the outer peripheral surface.

16. The turbine blade assembly according to claim 14, wherein the chamfer surface extends between the upper surface and the inner peripheral surface.

17. The turbine blade assembly according to claim 14, wherein the chamfer surface comprises a thermal barrier coating.

18. The turbine blade assembly according to claim 14, wherein the squealer tip cooling hole is one of a cylindrical hole, a fan-shaped hole, a counterbore hole, and a branched hole.

19. The turbine blade assembly according to claim 14, wherein the chamfer part extends from a first position to a second position along the suction side rail, and wherein the first position is at a first distance from the leading edge and the second position is at a second distance from the trailing edge, and wherein the first distance is less than or greater than the second distance; and/or wherein the first distance is between 10 percent and 80 percent, preferably between 10 percent and 40 percent, and more preferably 20 percent, of a length of the suction side at the airfoil tip part of the airfoil; and/or wherein the second distance is between 10 percent and 80 percent, preferably between 20 percent and 60 percent, and more preferably 40 percent, of a length of the suction side at the airfoil tip part of the airfoil.

20. The turbine blade assembly according to claim 14, wherein the suction side rail comprises at least one non-chamfer part adjacent to the chamfer part; and wherein the non-chamfer part extends between the chamfer part and the leading edge, and/or wherein the non-chamfer part extends between the chamfer part and the trailing edge.

* * * * *